US008025356B2

(12) United States Patent
Habashi

(10) Patent No.: US 8,025,356 B2
(45) Date of Patent: Sep. 27, 2011

(54) IMAGE FORMING APPARATUS HAVING LIQUID DROPLET DETECTION UNIT

(75) Inventor: Hisashi Habashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 271 days.

(21) Appl. No.: 12/201,342

(22) Filed: Aug. 29, 2008

(65) Prior Publication Data

US 2009/0058921 A1 Mar. 5, 2009

(30) Foreign Application Priority Data

Sep. 4, 2007 (JP) ..... 2007-229556
Jun. 17, 2008 (JP) ..... 2008-157808

(51) Int. Cl.
*B41J 29/393* (2006.01)
*B41J 2/165* (2006.01)
*B41J 2/155* (2006.01)

(52) U.S. Cl. ..... 347/19; 347/29; 347/42

(58) Field of Classification Search ..... 347/19
See application file for complete search history.

(56) References Cited

U.S. PATENT DOCUMENTS 5,255,009 A * 10/1993 Bauer et al. ..... 346/25
5,381,169 A * 1/1995 Arai et al. ..... 347/33
5,798,775 A * 8/1998 Takahashi et al. ..... 347/33
6,877,838 B2 * 4/2005 Elgee ..... 347/40
2002/0158938 A1 * 10/2002 Doval
2005/0057603 A1 * 3/2005 Hirakata et al. ..... 347/30
2005/0146550 A1 * 7/2005 Kusakari ..... 347/19
2005/0156996 A1 * 7/2005 Sakurai ..... 347/33
2006/0170733 A1 * 8/2006 Lee
2007/0171249 A1 * 7/2007 Usuda
2008/0225069 A1 * 9/2008 Miyazawa ..... 347/14
2009/0135226 A1 * 5/2009 Sakamoto et al. ..... 347/33

FOREIGN PATENT DOCUMENTS

JP 10-206624 8/1998
JP 2838894 10/1998
JP 2004-209734 7/2004
JP 2004-216339 8/2004
JP 2005-178290 7/2005

(Continued)

OTHER PUBLICATIONS

English translation of patent document JP 2006-213051 to Lee et al., "Inkjet Printing Device and Manufacturing Method for Liquid Crystal Display Device using it and Ejection Method for Ejection Liquid," machine generated; 11 pp.*

(Continued)

*Primary Examiner* — Shelby Fidler
(74) *Attorney, Agent, or Firm* — Cooper & Dunham LLP

(57) ABSTRACT

A liquid ejection head unit has plural liquid ejection heads and a liquid droplet detection device that detects liquid droplets ejected from the heads. The liquid droplet detection device has LD arrays that are provided at one side surface in the longitudinal direction of the head unit and serve to emit light beams; photo diodes that are provided at the other side surface in the longitudinal direction of the head unit and serve to receive the light beams emitted from the LD arrays; and a light path forming unit that causes the light beams emitted from the LD arrays to pass through along a head surface as detection light beams from the outer side of an area capped by a cap of a maintenance and recovery mechanism of an image forming apparatus and that causes the emitted light beams to be incident on the light-receiving unit provided at the outer side of the area.

13 Claims, 35 Drawing Sheets

FOREIGN PATENT DOCUMENTS

| | | |
|---|---|---|
| JP | 2005-186381 | 7/2005 |
| JP | 2005-199658 | 7/2005 |
| JP | 2005-280351 | 10/2005 |
| JP | 2005-319698 | 11/2005 |
| JP | 2005-342899 | 12/2005 |
| JP | 2006-110964 | 4/2006 |
| JP | 3813762 | 6/2006 |
| JP | 2006-187981 | 7/2006 |
| JP | 2006-192789 | 7/2006 |
| JP | 2006-213051 | 8/2006 |

OTHER PUBLICATIONS

English translation of patent document JP 2006-213051 to Lee et al., "Inkjet Printing Device and Manufacturing Method for Liquid Crystal Display Device using it and Ejection Method for Ejection Liquid," 11 pp, machine generated Aug. 30, 2010 (this document was made of record Sep. 7, 2010).*

Mar. 24, 2010 European search report in connection with counterpart European patent application No. EP 08252721.9.*

* cited by examiner

IMAGE FORMING APPARATUS HAVING LIQUID DROPLET DETECTION UNIT

BACKGROUND

1. Technical Field

This disclosure generally relates to liquid ejection head units and image forming apparatuses and, in particular, to a liquid ejection head unit and an image forming apparatus capable of detecting liquid droplets ejected from a liquid ejection head.

2. Description of the Related Art

General image forming apparatuses, such as printers, facsimile machines, copiers, plotters, or multi-task machines having plural functions thereof, include a recording head composed of liquid ejection heads that eject liquid droplets of ink so as to form images. During image formation (used synonymously with recording, printing, and imaging), the image forming apparatuses cause the liquid droplets of the ink to adhere to a sheet, while transferring a medium (hereinafter referred also to as a "sheet," but it does not limit a material. Also, it is used synonymously with a print medium, a medium to be recorded, a recording medium, a transfer member, a recording paper, etc.).

Note that the "image forming apparatus" refers to an apparatus that ejects liquid onto a medium such as a paper, a thread, a fiber, a fabric, leather, metal, a plastic, glass, wood, and a ceramic so as to perform the image formation. Furthermore, the "image formation" refers to forming on the medium not only meaningful images such as characters and graphics, but also meaningless images such as patterns (merely, ejection of liquid droplets). Furthermore, the "ink" is not limited to narrowly-defined ink and is not particularly limited so long as it turns into liquid when ejected. For example, the ink refers also to a DNA sample, a resist, a pattern material, a resin material, etc.

In such a liquid-ejection-type image forming apparatus, liquid droplets are ejected from fine pores called nozzles of the liquid ejection head, thereby making it possible to form patterns on the medium in a non-contact manner. Therefore, the image formation is made possible in a single image forming process regardless of the types and shapes of the medium.

Each of the nozzles has a fine orifice having a diameter of 50 μm or smaller and ejects liquid droplets from the orifice. Therefore, it is very difficult to maintain the nozzle in a normal state. Particularly, in the case of a line-type head having nozzle arrays in which nozzles having a width equivalent to that of the medium are arranged side by side, there are an enormous number of (several hundred through several thousand) nozzles. Therefore, it is a significant problem to maintain all the nozzles in a normal state, while avoiding ejection failures, such as a case in which the liquid droplets cannot be ejected from the nozzles, a case in which the liquid droplets are not ejected in the direction approximately perpendicular to a nozzle surface, and a case in which a desired size of the liquid droplets cannot be ejected.

Thus, it is necessary to identify an ejection failure nozzle and recover its operation so as to maintain the nozzle in a normal state. Conventionally, in a personal ink jet printer, etc., a nozzle check pattern is printed on a sheet so as to visually confirm the states of nozzles. However, this method wastefully consumes a sheet and requires time for the user to get accustomed to visually confirm the pattern.

To address the above problem, as shown in Patent Document 1, an apparatus that optically confirms liquid droplets ejected from nozzles so as to confirm an ejection state is installed in a wide format ink jet printer, etc., and it has been put into practice.

Patent Document 1: JP-A-2006-187981

Furthermore, in a conventional serial-type image forming apparatus, as shown in Patent Document 2, a device for detecting an ejection state is provided near an idle-ejection receiver in which liquid droplets not contributing to image formation are ejected.

Patent Document 2: JP-A-2005-319698

As opposed to this, in a line-type image forming apparatus, it is not necessary for a head unit to move during its printing operation. Therefore, Patent Document 3 describes a liquid ejection recording apparatus that has an ejection detecting device in a cap member of a maintenance and recovery apparatus that maintains and recovers a head unit and detects liquid droplets when the head unit moves to the position for a maintenance and recovery operation.

Patent Document 3: JP-B2-2838894

Furthermore, Patent Document 4 describes an ink jet printer that has a device for detecting an ejection state on a path on which a head unit moves to the position for a maintenance and recovery operation.

Patent Document 4: JP-A-2005-199658

Furthermore, Patent Document 5 describes an apparatus that has a moving unit that makes it possible for a detector for detecting an ejection state to be moved relative to a head unit.

Patent Document 5: JP-A-2006-192789

Furthermore, Patent Document 6 describes an ink jet apparatus that provides detectors for respective nozzles.

Patent Document 6: JP-A-2006-213051

As for the apparatuses described in Patent Documents 3 and 4 that move the head unit to the maintenance position, thereby making it possible to detect an ejection state, it is necessary to move a head position during its printing operation so as to confirm the ejection state. Therefore, in order to confirm the ejection state, printing speed may be remarkably reduced.

On the other hand, according to the configuration described in Patent Document 5 that has the moving unit that makes it possible for the detector to be moved relative to the head unit, it is difficult to precisely move the detector. In addition, if there is a failure in the moving unit of the detector, a target head unit cannot be detected. Therefore, sufficient reliability is not obtained.

Furthermore, according to the configuration described in Patent Document 6 that has the detectors for the nozzles, it is possible to confirm an ejection state during a printing operation, thus attaining high speed and reliability. However, because the detector is provided for each nozzle, the interval between the detectors is small. Therefore, it is necessary to provide the detectors with high processing precision. In addition, with the provision of many detectors, a wiring circuit becomes complicated. Therefore, the costs of the head unit increase due to an ejection detecting mechanism. Furthermore, because the number of the detectors correspond to the number of the nozzles, it is necessary to maintain all the detectors in a normal state. Therefore, it is difficult to maintain the reliability of the detectors themselves. Moreover, in the case of optical detection, heat is generated when light-emitting elements drive as the detectors, thereby causing the rise of the temperature of the head unit and the reduction of the sensitivity of light-receiving elements. Accordingly, when the detectors are provided for the respective nozzles, a lot of heat is generated due to the accumulation of the light-emitting parts.

BRIEF SUMMARY

In an aspect of this disclosure, there is provided an approach to detect the ejection of liquid droplets with a simple configuration without moving a head.

According to another aspect, there is provided a liquid ejection head unit comprising a liquid ejection head that has a nozzle surface provided with plural nozzles through which a liquid droplet is ejected, and a liquid droplet detection unit that detects the liquid droplet ejected from the liquid ejection head. The liquid droplet detection unit has a light-emitting unit that emits a light beam, a light-receiving unit that receives the light beam emitted from the light-emitting unit, and a light path forming unit that causes the light beam emitted from the light-emitting unit to pass through along the nozzle surface from an outer side of an area capped by a capping unit of a maintenance and recovery mechanism of an image forming apparatus and that causes the light beam to be incident on the light-receiving unit provided at the outer side of the area.

Preferably, a groove may be provided between the outer side of the capped area and any of the light-emitting unit, the light-receiving unit, and the light path forming unit. Further, the liquid droplet detection unit may have a digital micro mirror device that selects the light beam to be incident on the light-receiving unit. Alternatively, the liquid droplet detection unit may have a unit that scans the light beam emitted from the light-emitting unit along the nozzle surface. Further, the light-emitting unit may come into contact with a channel of ink ejected as the liquid droplet via a thermally-conductive member. The liquid ejection head unit may further comprise a movable protection member that covers and protects any of the light-emitting unit, the light-receiving unit, and the light path forming unit.

Further, at least a part of members constituting the light-emitting unit, the light-receiving unit, and the light path forming unit of the liquid droplet detection unit may be provided on the side of the liquid ejection head, and the rest of the members may be provided on the side of a member that supports the liquid ejection head.

According to another aspect, there is provided an image forming apparatus comprising the aforementioned liquid ejection head for forming an image on a printing medium.

Preferably, detection by the liquid droplet detection unit may be performed when a liquid droplet that does not contribute to image formation is ejected. Further, the passing direction of the light beam emitted from the liquid droplet detection unit may intersect with the wiping direction of a wiping member that wipes off the nozzle surface of the liquid ejection head.

According to another aspect of this disclosure, a liquid droplet detection unit has a light-emitting unit that emits light beams, a light-receiving unit that receives the light beams emitted from the light-emitting unit, and a light path forming unit that causes the light beams emitted from the light-emitting unit to pass through along a nozzle surface from the outer side of an area capped by a capping unit and that causes the light beams to be incident on the outer side of the area. Accordingly, it is possible to detect liquid droplets ejected from a head with a simple configuration without moving the head and interrupting the capping of the head.

With the provision of the aforementioned liquid ejection head unit, the image forming apparatus can stably form high-quality images.

The aforementioned and other aspects, features and advantages will become more apparent from the following detailed description when read in conjunction with the accompanying drawings.

DETAILED DESCRIPTION OF THE PREFERRED EMBODIMENTS

Figure 1:
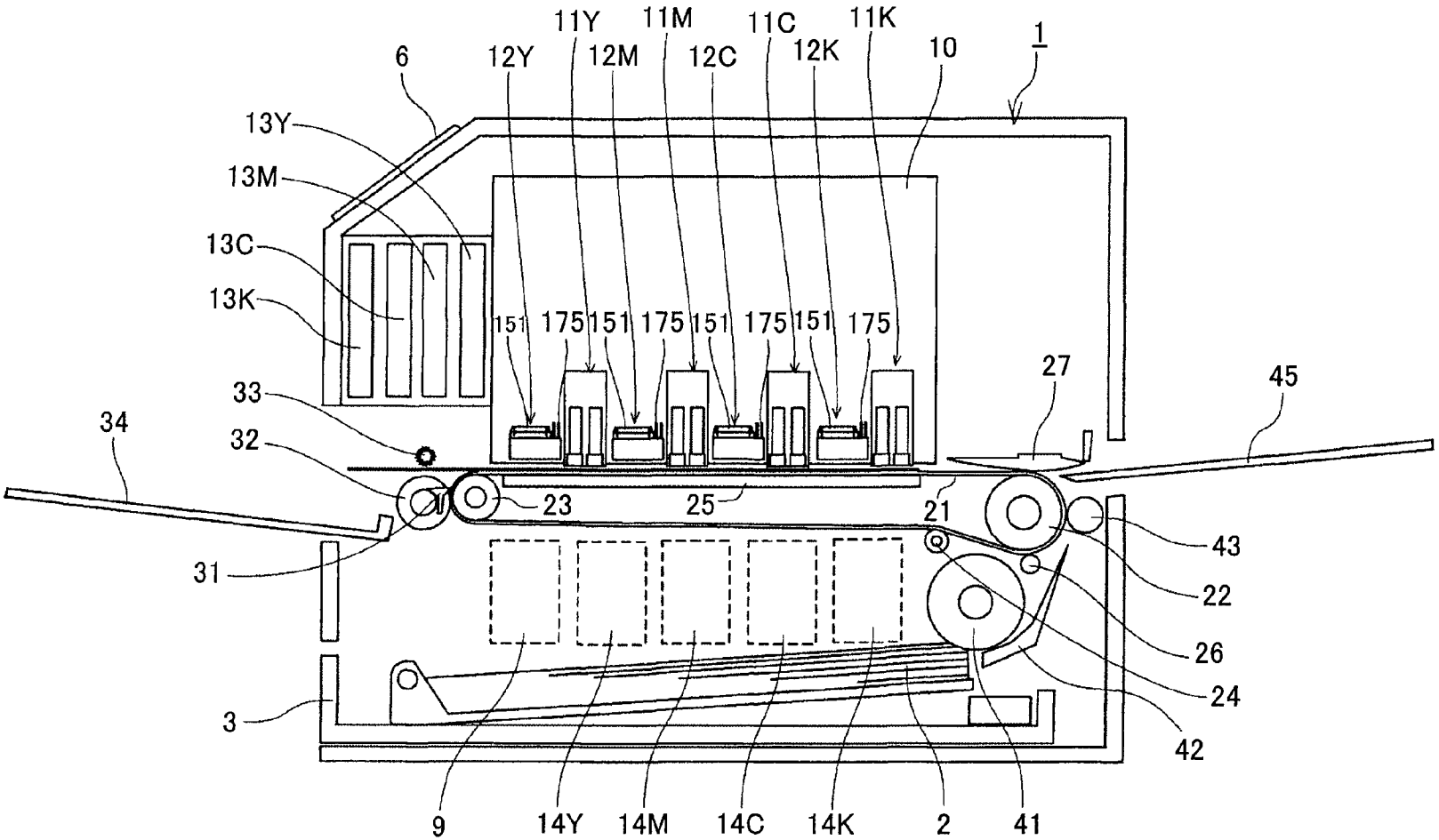
FIG. 1 is a schematic side view showing an example of an image forming apparatus according to the embodiments of the present invention.

Referring to the accompanying drawings, a description is now made of the embodiments of the present invention. First, referring to FIG. 1, a description is made of an example of an ink jet recording apparatus as an image forming apparatus according to the embodiments of the present invention. Note that FIG. 1 is a schematic view for explaining the ink jet recording apparatus.

The ink jet recording apparatus is a line-type image forming apparatus. Inside its apparatus main body 1, a head holding member 10 holds head units 11Y, 11M, 11C, and 11K (hereinafter numerals not having the sub-numerals of Y, M, C, and K are used when colors are not differentiated from one another. The same applies to other members, etc.) as line-type liquid ejection heads (recording heads) composed of plural liquid ejection heads (hereinafter simply referred to as "heads" in some cases) that eject respective colors of ink including black (K), cyan (C), magenta (M), and yellow (Y). The head holding member 10 also holds maintenance units (maintenance and recovery mechanisms) 12K, 12C, 12M, and 12Y that have a cap 151 as a capping unit, a suction pump as a sucking unit, a wiper blade 175 as a wiping unit, etc., for performing a maintenance operation (a maintenance and recovery operation, etc.) for the head units 11K, 11C, 11M, and 11Y, respectively.

Inside the apparatus main body 1, the ink jet recording apparatus also has ink cartridges 13K, 13C, 13M, and 13Y that accommodate ink to be supplied to liquid ejection heads 101A through 101L of the head unit 11 and sub-tanks 14K, 14C, 14M, and 14Y that temporarily store ink supplied from the ink cartridge 13 and supply the ink to the liquid ejection heads 101A through 101L with a proper pressure.

Furthermore, inside the apparatus main body 1, the ink jet recording apparatus has a transferring mechanism composed of a transferring belt 21 that receives a printing medium 2 (hereinafter referred to as a "sheet") and transfers the same, transferring rollers 22 and 23 around which the transferring belt 21 is wrapped, a tension roller 24 that controls the transferring belt 21 to maintain its adequate planarity, a charging roller 26 that applies electrostatic charging onto the transferring belt 21 to receive the sheet 2, a pressing member 27 that presses the sheet 2 against the transferring belt 21 at a position opposing the transferring roller 22, etc.

Moreover, the ink jet recording apparatus has a sheet ejecting mechanism composed of a separating claw 31 that separates the sheets 2 from the transferring belt 21, a sheet ejecting roller 32 that performs a transferring operation to eject the sheet 2, a spur 33 that opposes the sheet ejecting roller 32, and a sheet receiving tray 34 that receives the ejected sheet 2. In addition, the ink jet recording apparatus has a sheet feeding mechanism composed of a sheet feeding tray 3 that stores plural of the sheets 2 on which an image is formed, a sheet feeding roller 41 that separates the sheets 2 one by one from the sheet feeding tray 3 and transferring the same, a separating pad 42 that opposes the sheet feeding roller 41, a counter roller 43 that causes the fed sheet 2 to be reliably sucked onto the transferring belt 21, and a manual feeding tray 45 for manual feeding.

Furthermore, the ink jet recording apparatus also has a waste-liquid tank 9 that collects waste liquid ejected when a maintenance operation is performed and has an operations panel 6 through which the ink jet recording apparatus is operated and which can display statuses of the apparatus.

Figure 2:
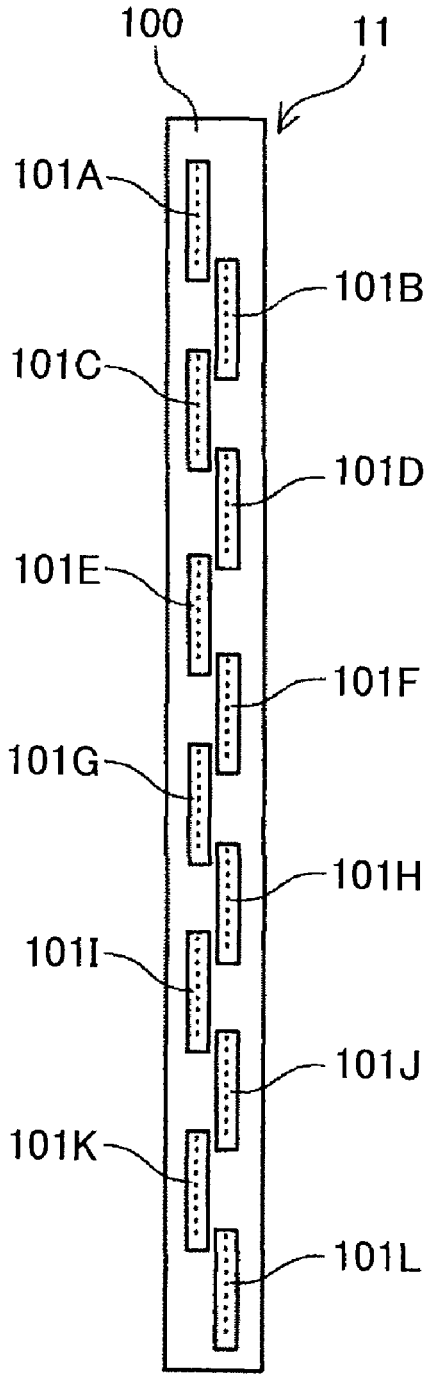
FIG. 2 is a plan view showing an example of a head unit of the image forming apparatus as viewed from its nozzle surface.
Figure 3:
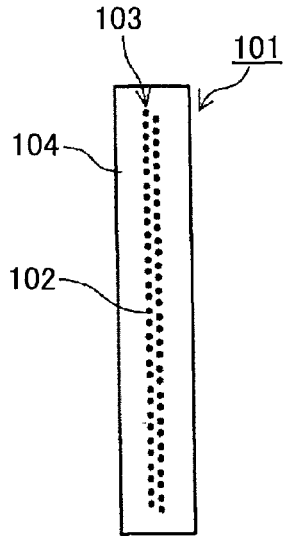
FIG. 3 is an enlarged plan view showing a liquid ejection head constituting the head unit as viewed from its nozzle surface.

Here, referring to FIGS. 2 and 3, a description is made of an example of the head unit 11 constituting the recording head of the image forming apparatus. Note that FIG. 2 is a plan view showing the head unit 11 as viewed from its nozzle surface, and FIG. 3 is an enlarged plan view showing one liquid ejection head constituting the head unit 11 as viewed from its nozzle surface.

Figure 4:
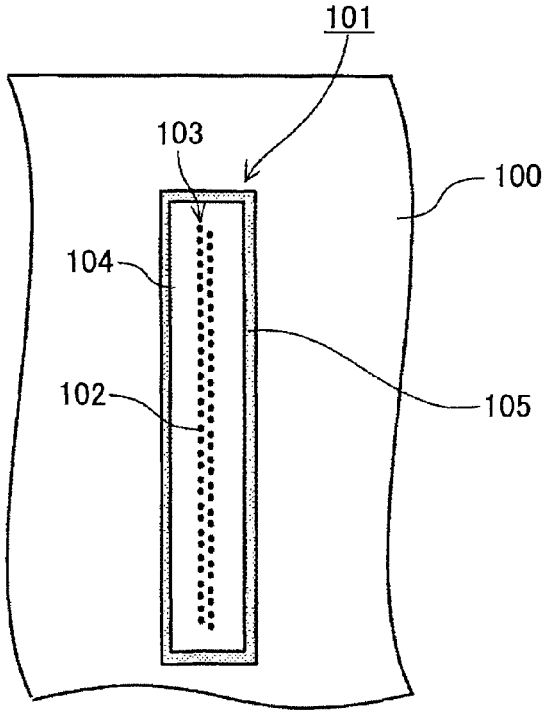
FIG. 4 is an enlarged view of a substantial part showing a surrounding part of the liquid ejection head constituting the head unit as viewed from its nozzle surface.

The head unit 11 is configured so that twelve liquid ejection heads 101A through 101L are arranged zigzag in two rows so as to be partially overlapped with each other in the direction in which nozzles 102 formed on a nozzle surface 104 are arranged (in the direction along nozzle arrays 103). The one liquid ejection head 101 has the nozzle surface 104 on which the nozzle arrays 103 having plural of the nozzles 102 for ejecting liquid droplets side by side are arranged zigzag in two rows. As shown in FIG. 4, a filler 105 is filled between a head supporting member 100 and the liquid ejection head 101 so as to hermetically seal them, thereby eliminating a gap between the nozzle surface 104 and the head supporting member 100.

Furthermore, the head supporting member 100 and the nozzle surface 104 are fixed so as to be positioned on approximately the same plane. In other words, if there is a gap between the nozzle surface 104 and the head supporting member 100 as a peripheral member of the liquid ejection head at the time of a wiping operation, a wiper blade 175 gets struck with the gap. As a result, the wiping blade 175 cannot come into contact with the nozzle surface 104 with a uniform force. Therefore, ink is caused to be left on the nozzle surface 104 at the time of the wiping operation. In addition, if there is the gap between the nozzle surface 104 and the head supporting member 100, a dead angle which the wiper blade 175 cannot come into contact with exists. As a result, ink is likely to be accumulated in the gap. Therefore, image quality is degraded as the ink accumulated in the gap drops onto the sheet 2. Moreover, because a pressure applied to the wiper blade 175 is locally increased due to the gap, a friction between the wiper blade 175 and its contact position increases. Therefore, the wiper blade 175 is caused to have the friction at the contact end surface of the nozzle surface 104.

Figure 5:
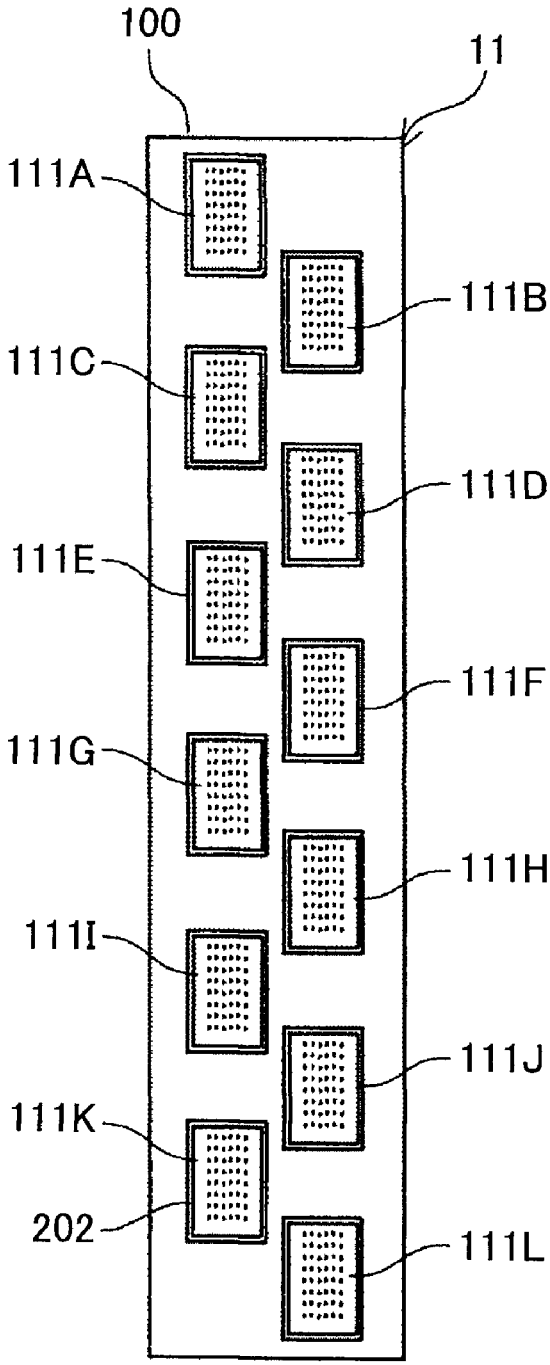
FIG. 5 is a plan view showing another example of the head unit of the image forming apparatus as viewed from its nozzle surface.
Figure 6:
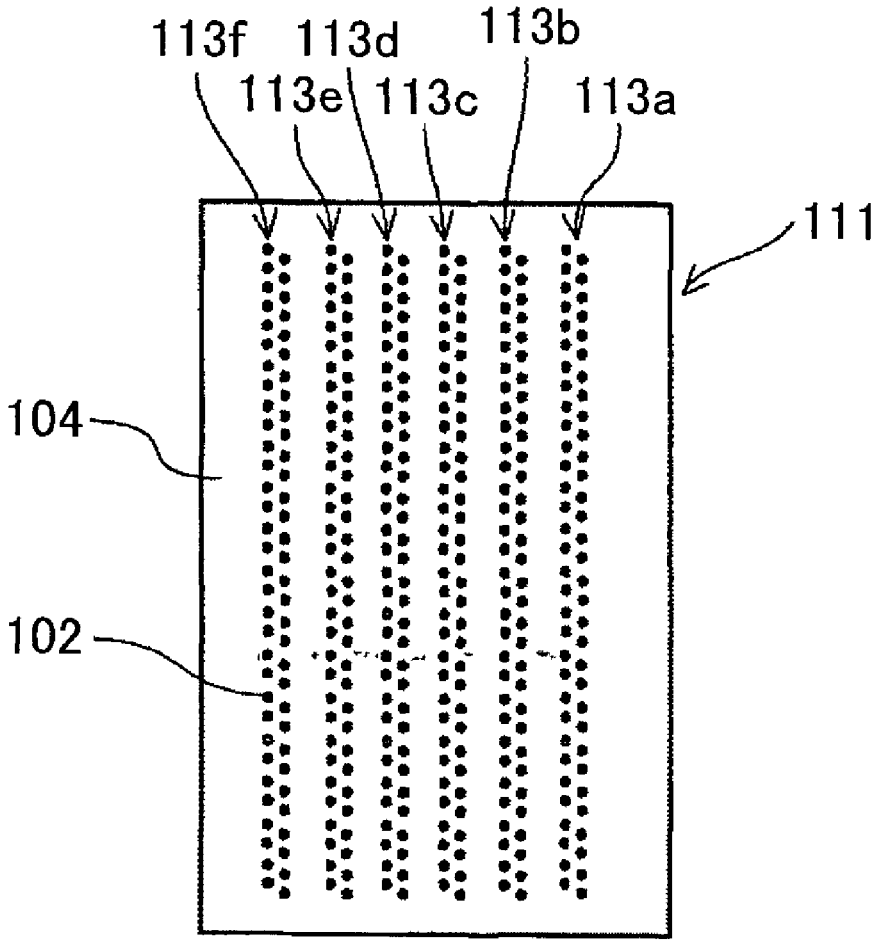
FIG. 6 is an enlarged plan view showing the liquid ejection head constituting the head unit as viewed from its nozzle surface.

Next, referring to FIGS. 5 and 6, a description is made of another example of the head unit 11 constituting the recording head of the image forming apparatus. Note that FIG. 5 is a plan view showing the head unit 11 as viewed from its nozzle surface, and FIG. 6 is an enlarged plan view showing one liquid ejection head constituting the head unit 11 as viewed from its nozzle surface.

The head unit 11 is configured so that twelve liquid ejection heads 111A through 111L are arranged zigzag in two rows so as to be partially overlapped with each other in the direction in which nozzles 113 are arranged (in the direction along nozzle arrays 113). The one liquid ejection head 111 has the nozzle surface 104 on which the nozzle arrays 113*a* through 113*f* having plural nozzles 113 ejecting liquid droplets side by side are arranged zigzag in two rows. A filler is filled between the head supporting member 100 and the liquid ejection head 111 so as to hermetically seal them, thereby eliminating a gap between the nozzle surface 104 and the head supporting member 100.

In the case of using the head unit 11, the color of ink is differentiated for each of the nozzle arrays 113*a* through 113*f*, thereby making it possible to perform multiple-coloring without increasing the size of the apparatus. Furthermore, in the case of using the same color of ink, the liquid ejection head that cannot simultaneously eject ink from all nozzles makes it possible to eject the ink from the plural nozzle arrays. Therefore, it is possible for the liquid ejection head to eject the same ink without thinning it out. As a result, printing speed can be improved. When the multiple-coloring is performed by the head unit 11 thus configured, precision in shooting position is the highest in an adjacent nozzle array. Therefore, it is preferred to arrange dark colors of ink, by which a shooting position is easily detected, on the central side of the head unit 11 and arrange light colors of ink on the outer edge side of the head unit 11. For example, in the case of using six colors of ink including photo cyan (PC) and photo magenta (PM), it is preferred to allocate PM, PC, Y, M, C, and K to the nozzles arrays in this order from the outer nozzle array 113*f* to the inner nozzle array 113*a* for the liquid ejection head 111A and allocate PM, PC, Y, M, C, and K in this order from the outer nozzle array 111*a* to the inner nozzle array 111*f* for the liquid ejection head 111B.

In the image forming apparatus thus configured, the nozzle arrays of each head unit 11 are arranged so as to be orthogonal to the transferring direction of the sheet 2 and formed to have the length equal to or larger than that of a recording area. The sheets 2 are separated one by one from the sheet feeding tray 3 by the sheet feeding roller 41 and fed to the charging roller 26. Then, the sheet 2 is closely attached to the transferring belt 21 and fixed thereon by electrostatic attraction. When the sheet 2 passes through the position below the head unit 11, liquid droplets are ejected to form a desired image on the sheet 2. After that, the sheet 2 is separated from the transferring belt 21 by the separating claw 31 and then ejected onto the sheet receiving tray 34 while being supported by the sheet ejecting roller 32 and the spur 33.

Figure 7:
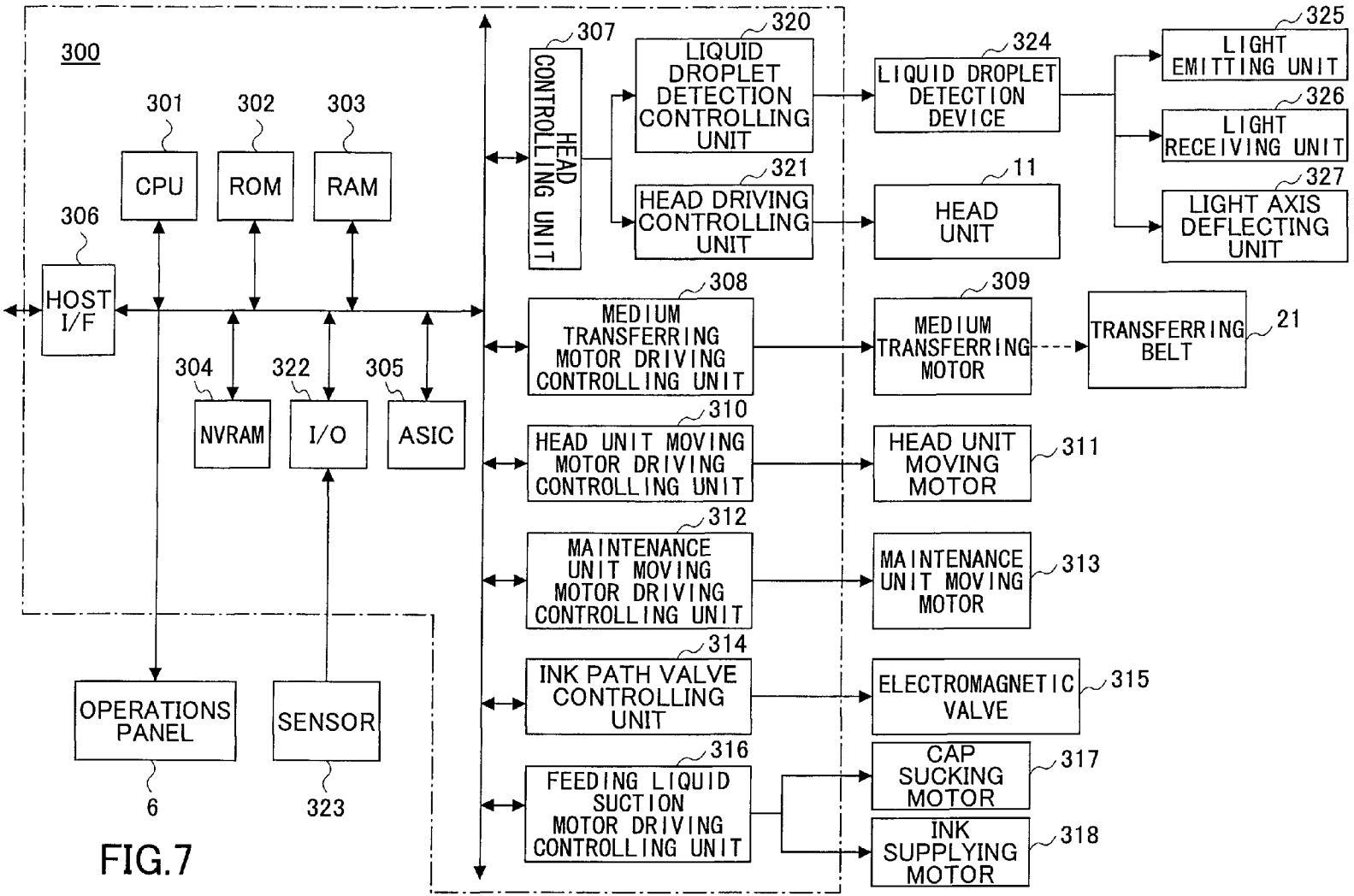
FIG. 7 is a block diagram showing an outline of a controlling unit of the ink jet recording apparatus.

Next, referring to FIG. 7, a description is made of an outline of a controlling unit of the ink jet recording apparatus. Note that FIG. 7 is a block diagram for entirely explaining the controlling unit.

The controlling unit 300 has a CPU 301 that entirely controls the ink jet recording apparatus; a ROM 302 that stores values of variations in light-receiving sensitivity and sensitivity thresholds regarded as liquid droplet detection in detecting a predetermined liquid droplet ejection, driving waveform data, and other fixed data; a RAM 303 that temporarily stores image data, etc.; a non-volatile memory (NVRAM) 304 that maintains data even when the power of the ink jet recording apparatus is turned off; and an ASIC 305 that performs image processing in which various signals for image data are processed and rearranged and that processes input and output signals for entirely controlling the ink jet recording apparatus.

Furthermore, the controlling unit 300 has a host I/F 306 that transmits and receives data and signals to and from a host; a head controlling unit 307 that generates a driving waveform for controlling the driving of a pressure generating unit of the liquid ejection head 154; a medium transferring motor driving controlling unit 308 that drives a medium transferring motor 309; a head unit moving motor driving controlling unit 310 that drives a head unit (carriage) moving motor 311; a maintenance unit moving motor driving controlling unit 312 that drives a maintenance unit moving motor 313; an ink path valve controlling unit 314 that controls the opening and closing of an electromagnetic valve 315 on an ink path; a feeding liquid suction motor driving controlling unit 316 that controls the driving of a cap sucking motor 317 and an ink supplying motor 318; an I/O 322 that receives detection signals from an encoder that outputs a detection signal in accordance with the moving amount and moving speed of the transferring belt 21 and a sensor 323 that detects an environmental temperature and an environmental humidity (or either of them), a detection signal for detecting the amount of ink of the sub-ink tank, and detection signals from various sensors (not shown). The controlling unit 300 is connected to the operations panel 6 on which information required for the ink jet recording apparatus is input and displayed.

With the I/F 306 printing data, etc., the controlling unit 300 receives from the host of an information processing apparatus such as a personal computer, an image reading apparatus such as an image scanner, an image pickup device such as a digital camera, or the like, via a cable or a network.

Then, the CPU 301 reads and analyzes the printing data of a receiving buffer included in the host I/F 306, causes the ASIC 305 to perform necessary image processing and rearrangement processing on the printing data, and transmits image data (dot pattern data) by an amount corresponding to one page in the width of the liquid ejection head 154 to the head driving controlling unit 307 in synchronization with a clock signal. Note that the dot pattern data for outputting an image may be generated, for example, using font data stored in the ROM 302. Alternatively, image data may be developed into raster data by the printer driver of the host and transferred to the ink jet recording apparatus.

The head controlling unit 307 transfers head driving information to a head driving controlling unit 321. The head driving controlling unit 321 selectively applies a voltage to the pressure generating unit of the liquid ejection heads 101 (or liquid ejection heads 111, hereinafter the same applies) of the head unit 11 based on image data (dot pattern data) corresponding to one page of the head unit 11, which are input on a page-by-page basis, so as to drive the liquid ejection heads 101 of the head unit 11.

Furthermore, the head controlling unit 307 transfers instructions for detecting liquid droplets issued from the CPU 301 to a liquid droplet detection controlling unit 320. The liquid droplet detection controlling unit 320 controls a liquid droplet detection device 324 as a liquid droplet detection unit of the present invention described below in accordance with instructed timing. As described in detail below, the liquid droplet detection device 324 detects the ejection states of liquid droplets from the respective liquid ejection heads 101 of the head unit 11 via a light-emitting unit 325, a light-receiving unit 326, and a light axis deflecting unit 327 (in the case of a second embodiment of the head unit described below) and transfers detection data obtained based on detection results to the CPU 301 via the liquid droplet detection controlling unit 320.

As the liquid ejection head for use in the image forming apparatus to which the present invention is applied, there can be employed, for example, a piezoelectric liquid ejection head that ejects liquid droplets when electrostriction elements are deflected with the application of a voltage, a thermal liquid ejection head that ejects liquid droplets when an electrothermal conversion element is heated with the application of a current to bubble the liquid, and an electrostatic liquid ejection head that deflects a vibration plate with an electrostatic force generated between the vibration plate and electrodes and ejects liquid droplets with the restoring force of the vibration plate. An actuator unit (a pressure generating unit) that causes liquid droplets to be ejected is not limited. The piezoelectric liquid ejection head can eject various sizes of liquid droplets by adjusting the driving waveform for driving a piezoelectric element. Therefore, it has an advantage in forming an image having excellent gradation. On the other hand, the thermal liquid ejection head facilitates high integration of nozzles. Therefore, it is suitable for manufacturing a liquid ejection head having a large number of nozzles and has an advantage in printing a high resolution image at high speed.

Furthermore, the liquid ejection head may be of an edge shooter type in which the shape from a liquid channel to ejection ports (nozzles) is linear, or may be of a side shooter type in which the orientation of a liquid channel is different from that of ejection ports.

The liquid to be used is not limited to narrowly-defined ink, and any of a resist, a DNA sample in a medical field, a resin lens material in an optics field, etc., can be used according to its intended purpose so long as it is liquidized within an endurance temperature range of a head member.

As the color material to be used for ink, any of a pigment and a dye can be used. Also, they can be used in a mixed state. The water dispersible coloring agent to be used for ink is not particularly limited, but it is preferred to use singly or in combination the water-dispersed coloring agents of a pigment dispersible in water without a dispersing agent after having one type of hydrophilic group bonded on its surface directly or via a group of atoms, a polymer emulsion obtained by incorporating a water-insoluble or poorly-soluble color material in resin fine particles, and a pigment dispersion-stabilized by the use of a surfactant and a water-soluble polymer compound having an average molecular weight of 50000 or smaller singly or in combination.

The type of a pigment to be used is not particularly limited. However, organic pigments or inorganic pigments can be used, and the organic pigments are preferably used in terms of gravity. Furthermore, plural types of the pigments may be used in a mixed state. The particle diameters of the pigments are preferably in the range 0.01 through 0.30 μm. Because a particle diameter of 0.01 μm or smaller is close to that of a dye, light resistance and feathering are degraded. Furthermore, a particle diameter of 0.30 μm or larger causes clogging at an ejection port and a filter of the ink jet ejection apparatus. Therefore, ejection stability cannot be obtained.

Such a water dispersible coloring agent has color material molecules that are in an aggregated state (including a crystallized state) or coexist with resin molecules. That is, the color material molecules do not exist monomolecularly. Therefore, the water dispersible coloring agent is excellent in water resistance, light resistance, and gas resistance. Using such a coloring agent makes it possible to improve image preservability. Particularly, in the case of using a pigment that is dispersible in water without a dispersing agent after having one type of hydrophilic group bonded on its pigment surface directly or via a group of atoms or using a polymer emulsion obtained by incorporating a water-insoluble or poorly-soluble color material in resin fine particles, the viscosity of ink to a coloring agent solid content is reduced. Therefore, it is possible for the pigment and the polymer emulsion to contain a large amount of water dispersible resins and wetting agents.

The resin to be used for ink is not particularly limited, but the pH of the water dispersible resin is preferably in the range 6 through 11 and more preferably in the range 7 through 9 in terms of miscibility with the water dispersible resin. As a characteristic of the water dispersible resin, the smaller an average particle diameter is, the higher its viscosity increases. In order to prevent the water dispersible resin from having an excessively-high viscosity, the average particle diameter of the water dispersible resin is preferably 50 nm or larger.

Moreover, because the ink channels and nozzle orifices of the liquid ejection head are small in size, it is known that the ability to eject ink is deteriorated if there are particles having a large particle diameter in the ink. In order to prevent the ability to eject ink from being inhibited, the average diameter of particles is preferably 500 nm or smaller and particularly preferably 150 nm or smaller. The water dispersible resin has preferably a function of fixing the water dispersible coloring agent on a sheet surface and has preferably a minimum film forming temperature (MFT) of 20° C. or lower so as to improve a fixing ability. However, when a glass transition point is at −40° C. or lower, the viscosity of a resin film increases, thereby causing tackiness in a printed matter. Therefore, the water dispersible resin has preferably a glass transition point of −30° C. or higher.

In order to provide the ink with desired properties or prevent the clogging of the nozzles of the recording head due to drying of the ink, it is preferred to use a water-soluble organic solvent besides the color material. The water-soluble organic solvent contains a wetting agent and a penetrating agent. The wetting agent is added to the water-soluble organic solvent so as to prevent the clogging of the nozzles of the recording head due to drying of the ink. The solvents are used singly or in combination together with water.

Furthermore, the penetrating agent is added to the water-soluble organic solvent so as to improve the wettability of the ink and a member (medium) to be recorded and adjust a penetrating speed. Examples of the penetrating agent include a polyoxyethylene alkylphenyl ether based surfactant, an acetylene glycol based surfactant, a fluorine based surfactant, a silicon based surfactant, a polyoxyethylene alkyl ether based surfactant, and a polyoxyethylene polyoxypropylene alkyl ether based surfactant. Because these compounds can reduce the surface tension of liquid, it is possible to improve the wettability and increase the penetrating speed.

The ink can contain a fungicide. Accordingly, the proliferation of bacteria can be suppressed. As a result, preservability and image quality stability can be improved. Furthermore, the ink can contain an anticorrosive agent. Accordingly, a coating film can be formed on a metal surface of the head, etc., where liquid contacts. As a result, corrosion can be prevented. Furthermore, the ink can contain an antioxidizing agent. Accordingly, even if radical species causing corrosion occur, the antioxidizing agent removes the radical species. As a result, corrosion can be prevented.

The ink can contain a pH adjuster. The pH of the ink is preferably in the range 3 through 11 and more preferably in the range 6 through 10 in terms of preventing the corrosion of a metal member where liquid contacts. The pH adjuster can adjust the pH of recording liquid according to the present invention so as to fall within a preferable range.

The surface tension of the ink is preferably in the range 20 through 60 mN/m and more preferably in the range 30 through 50 mN/m in terms of the wettability of a member to be recorded and the atomization of liquid droplets.

The viscosity of the ink is preferably in the range 1.0 through 20.0 mPa·s and more preferably in the range 2.0 through 10.0 mPa·s in terms of ejection stability.

Next, referring to FIGS. 8A through 8H, a description is made of a maintenance operation in the ink jet recording apparatus.

The caps 151 of the maintenance and recovery mechanisms 12 in the ink jet recording apparatus come into contact with the surfaces of the head supporting members 100 of the head unit 11 to collectively cap the plural liquid ejection heads 101. The surfaces of the head supporting members 100 which the caps 151 come into contact with are called "head surfaces 100A."

A printing operation is performed in a state shown in FIG. 1 with the head units 11 and the maintenance units 12 being parallel to one another. When the operations panel 6 or the host I/F 306 receives instructions for the maintenance operation or when the printing operation is successively performed for a certain period of time in a state in which the head units 11 are positioned on the printing surface (printing state), the maintenance operation (the maintenance and recovery operation) shown in FIGS. 8A through 8H is performed.

Figure 8A:
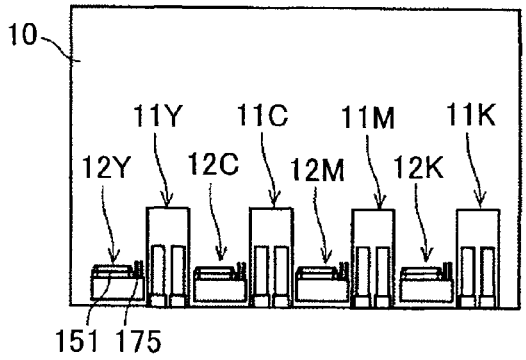
FIGS. 8A through 8H are illustrations for explaining a maintenance operation in the ink jet recording apparatus.
Figure 8B:
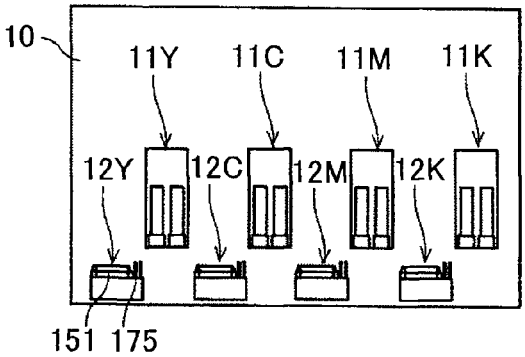
Figure 8C:
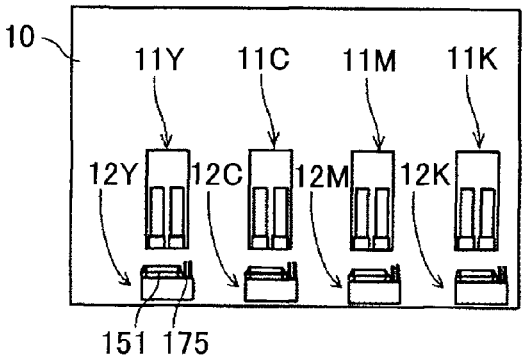

In the maintenance operation, the head units 11 and the maintenance units 12 first move to the maintenance position. That is, the head units 11 move upward from the predetermined position for the printing state (FIG. 8A) and stop at the highest position (FIG. 8B). Then, the maintenance units 12 move in parallel to the position right below the head units 11 and stop there (FIG. 8C). The head units 11 move downward to the position where they tightly adhere to the caps 151 and are put in a capping state.

Figure 8D:
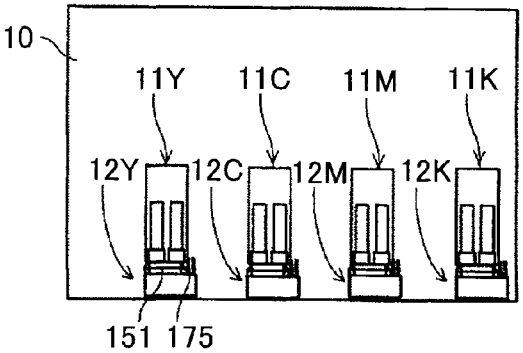
Figure 8E:
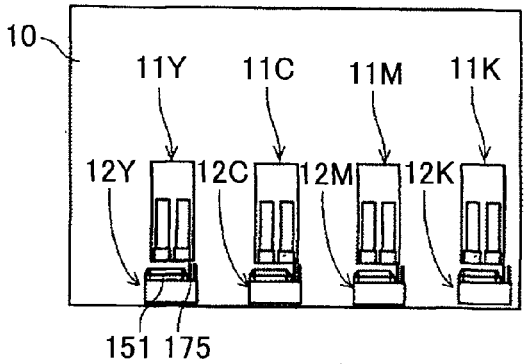
Figure 8F:
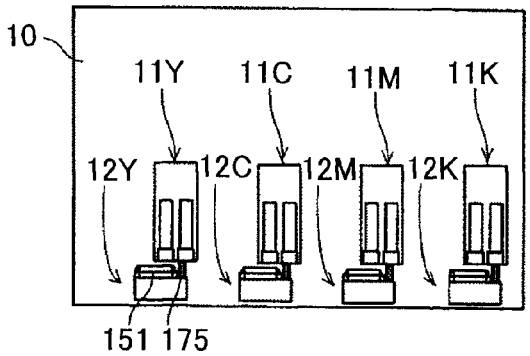

In the maintenance operation after the head units 11 cap the maintenance units 12, an ink ejection operation is performed, followed by a wiping operation. That is, in the wiping operation, the head units 11 move upward and stops at a wiping position about 0.2 through 0.5 mm lower than the top surface of the wiper blades 175 (FIG. 8E), and the maintenance units 12 move in parallel to perform the wiping operation on the head surface 100A of the head units 11 (FIG. 8F).

Then, the maintenance units 12 stop at the predetermined position for the printing state (FIG. 8G), and the head units 11 move right above their positions and stop there (FIG. 8B). Subsequently, the maintenance units 12 move to the position right below the head units 12 (FIG. 8C), and the head units 12 move downward to the position where they tightly adhere to the maintenance units 12 and are put in the capping state again (FIG. 8D).

After that, an idle ejecting operation (an operation in which liquid droplets that do not contribute to image formation are ejected) is performed with respect to the caps 151. After the maintenance units 12 are separated from the head units 11, the ink in the caps 151 are sucked so that the idle ejection ink is sucked and ejected from the caps 151.

Figure 8G:
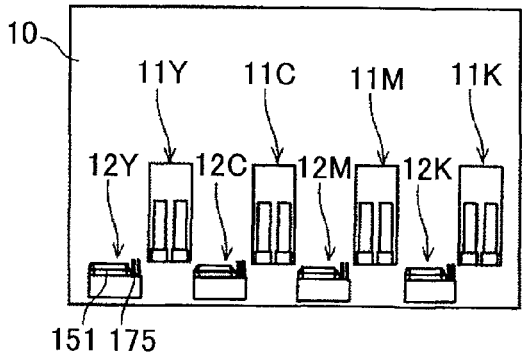
Figure 8H:
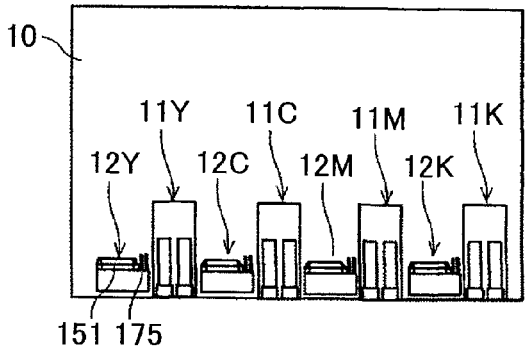

After the maintenance operation, the head units 11 and the maintenance units 12 move to the predetermined position for the printing state. The head units 11 move upward right above their positions and stop there (FIG. 8B), and the maintenance units 12 move in parallel up to the predetermined position for the printing state (FIG. 8G). Then, the head units 11 move downward and are put in the printing state again (FIG. 8H).

Note that, when the head units 11 and the maintenance units 12 are capable of moving separately as in the above case, the maintenance operation is applicable to a single head unit 11 and the maintenance operation (the ink ejection operation and the wiping operation) after the head units 11 cap the maintenance units 12 can be applied only to a target head unit 11.

Figure 9:
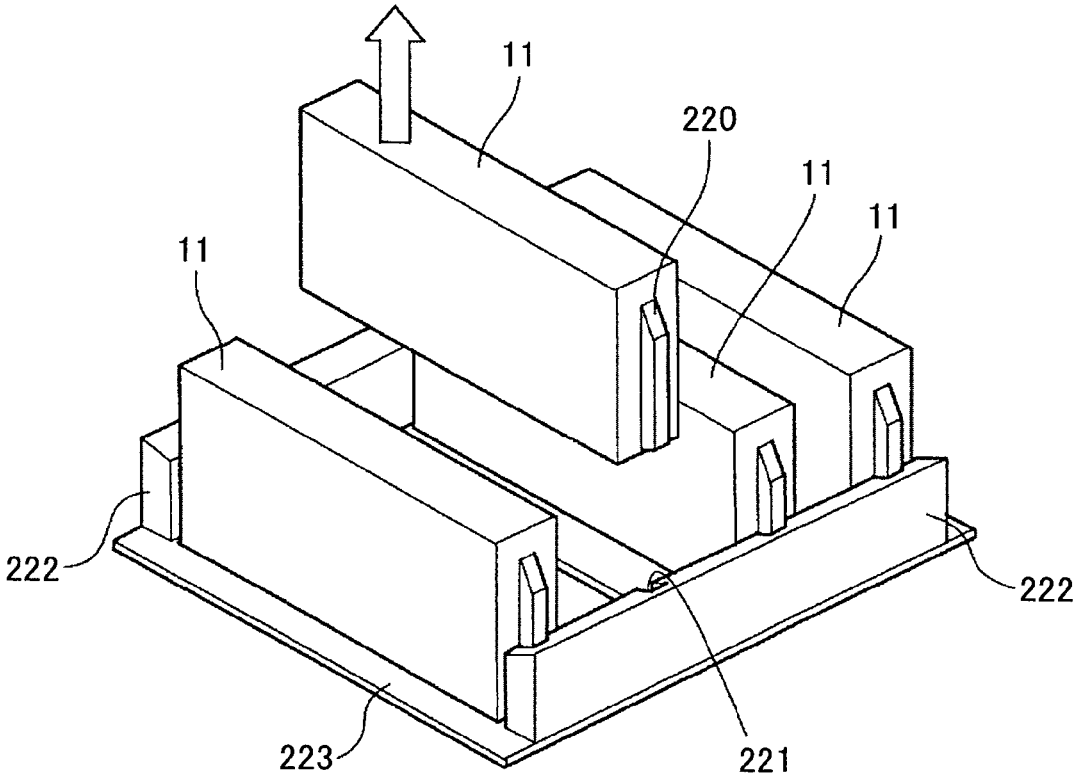
FIG. 9 is a perspective view for explaining the insertion and withdrawal of the head unit in the ink jet recording apparatus.

Furthermore, the ink jet recording apparatus may be configured to provide maintenance units adjacent to a sheet feeding path so that head units can move to the position of the maintenance units. As shown in FIG. 9, such head units can be roughly positioned in a head unit supporting member 223 in such a manner that positioning ribs 220 on its side surfaces are fitted in a positioning guide 221 of a head unit guide member 222 provided in the head unit supporting member 223.

The head units 11 are capable of being detached when pulled up so that they are freely replaced. The replacement of the head units 11 is easily performed where an ejection failure is not recovered or where there is a problem in the liquid droplet detection device 324. Because it is not necessary to match the light axes of the head units 11 and the liquid droplet detection device 324 each other, it is possible to replace the head units 11.

Figure 10:
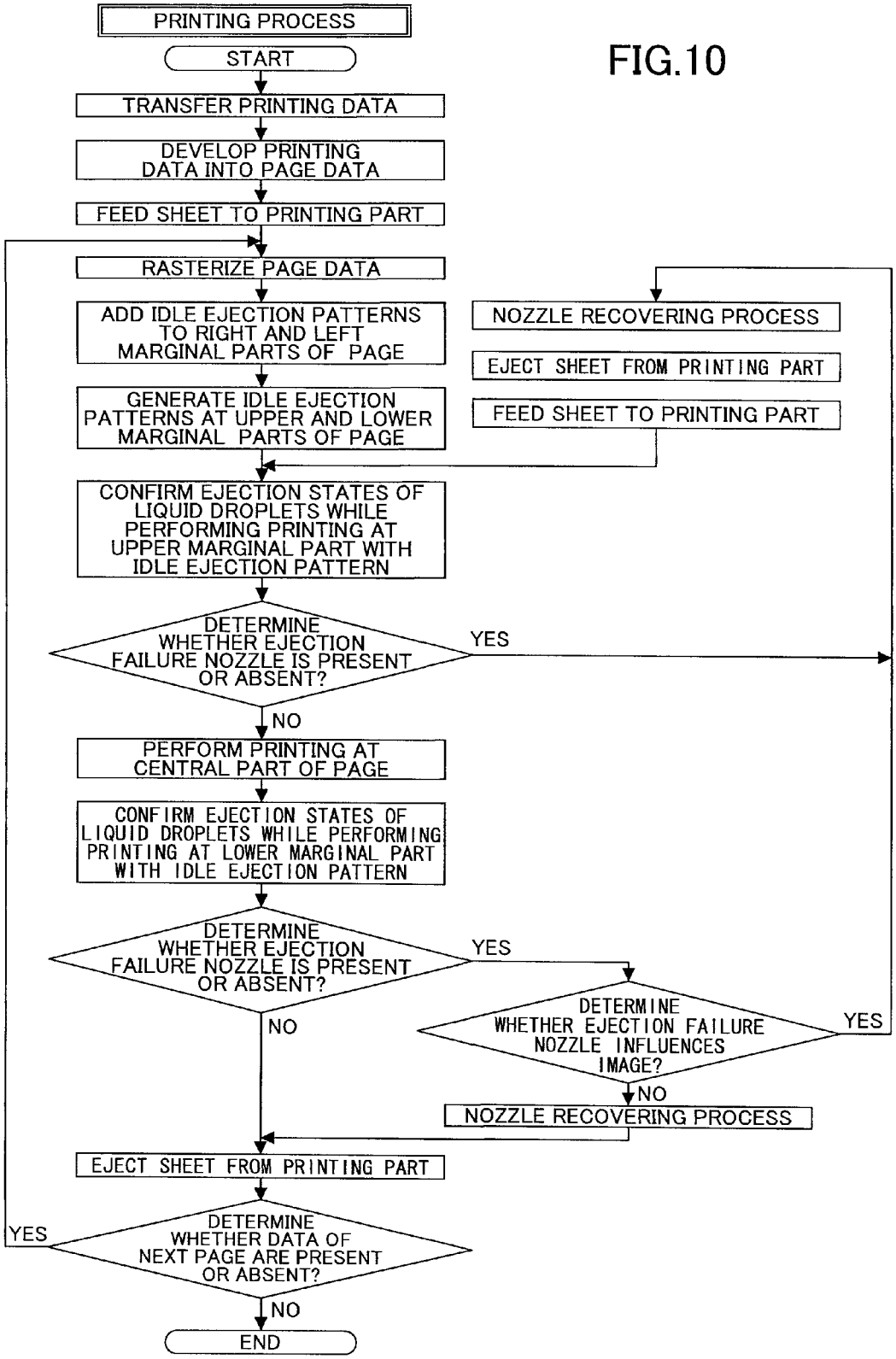
FIG. 10 is a flowchart for explaining a printing process in the ink jet recording apparatus.
Figure 11:
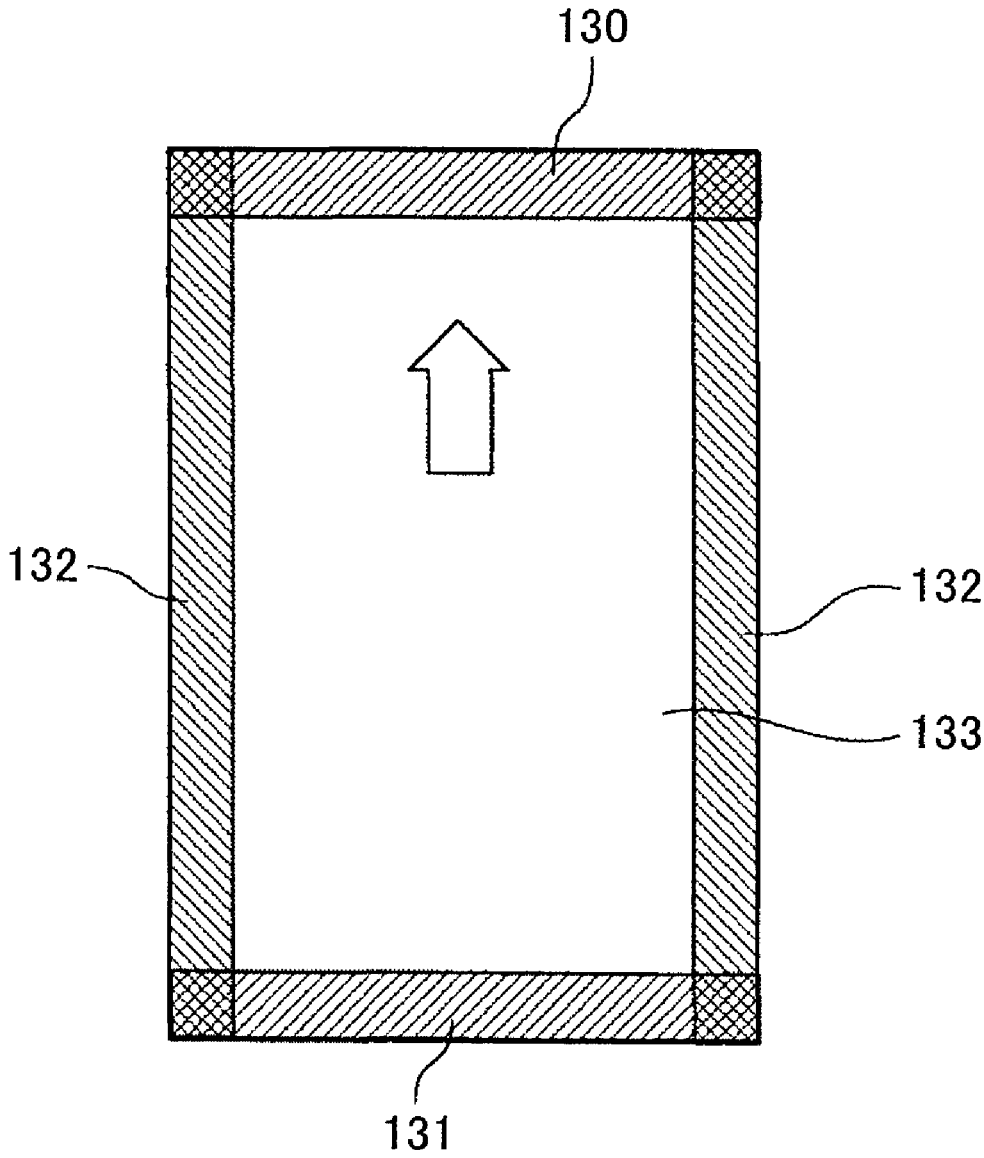
FIG. 11 is an illustration showing a printing medium and a printing area for explaining the printing process.

Next, referring to the flowchart of FIG. 10 and the illustration of FIG. 11, a description is made of liquid droplet ejection detection and printing control according to the embodiments of the present invention.

In a printing process, printing data are transferred and developed into page data while a sheet is fed to a printing part (printing area with respect to the head unit 11). The page data are rasterized to form main data (data to be printed at a central part 133 in FIG. 11) for image formation, and idle ejection patterns for an idle ejection in the printing operation are formed at right and left marginal parts (both end parts 132 in FIG. 11) and united with the main data. In order to make ejection pixels of idle ejection data inconspicuous, pixels adjacent to the ejection pixels are not ejected. In addition, in order to prevent the cyclic pattern of ejection liquid rows from being formed, the idle ejection data are formed using a blue noise mask, etc.

Similarly, upper and lower marginal parts (an upper end part 130 and a lower end part 131 in FIG. 11) are formed and united with the main data. In order to confirm the ejection, the ejection image of the data is preferably processed so as to suppress the ejections of other nozzles that would be inhibiting factors for detecting the ejection of a target nozzle.

When the image formation data are generated, the printing operation is performed on the upper marginal part with the idle ejection pattern together with the feeding of a sheet. Then, the ejection states of liquid droplets are detected by the liquid droplet detection device 324 to determine the presence or absence of an ejection failure nozzle.

If there is an ejection failure nozzle, the printing operation is suspended, and the nozzle concerned is subjected to a nozzle recovering process. Also, the printed sheet is ejected and removed from the printing part, and a new sheet is fed to the printing part. Then, the printing operation is performed again on the upper marginal part with the idle ejection pattern, while the states of liquid droplets are detected.

On the other hand, if there is no ejection failure nozzle, the central part of a page consisting of the main data and the idle ejection patterns at the right and left marginal parts is printed. Then, the printing operation is performed on the lower marginal part with the idle ejection pattern, while the ejection states of liquid droplets are detected by the liquid droplet detection device 324 to determine the presence or absence of an ejection failure nozzle.

Here, if there is an ejection failure nozzle, it is determined whether the nozzle concerned influences the images at the right and left marginal parts, etc. If the nozzle does not influence the images, it is subjected to the nozzle recovering process and the process is continued. On the other hand, if the nozzle influences the images, it is subjected to the nozzle recovering process. Also, the printed sheet is ejected and removed from the printing part, and a new sheet is fed to the printing part. Then, the printing operation of page data is performed again from the upper marginal part while determining whether there is an ejection failure nozzle.

On the other hand, if there is no ejection failure nozzle, the printed sheet is ejected from the printing part. Depending on the presence or absence of data of the next page, the above operation is repeatedly performed. The operation is performed until all data are output.

Figure 12:
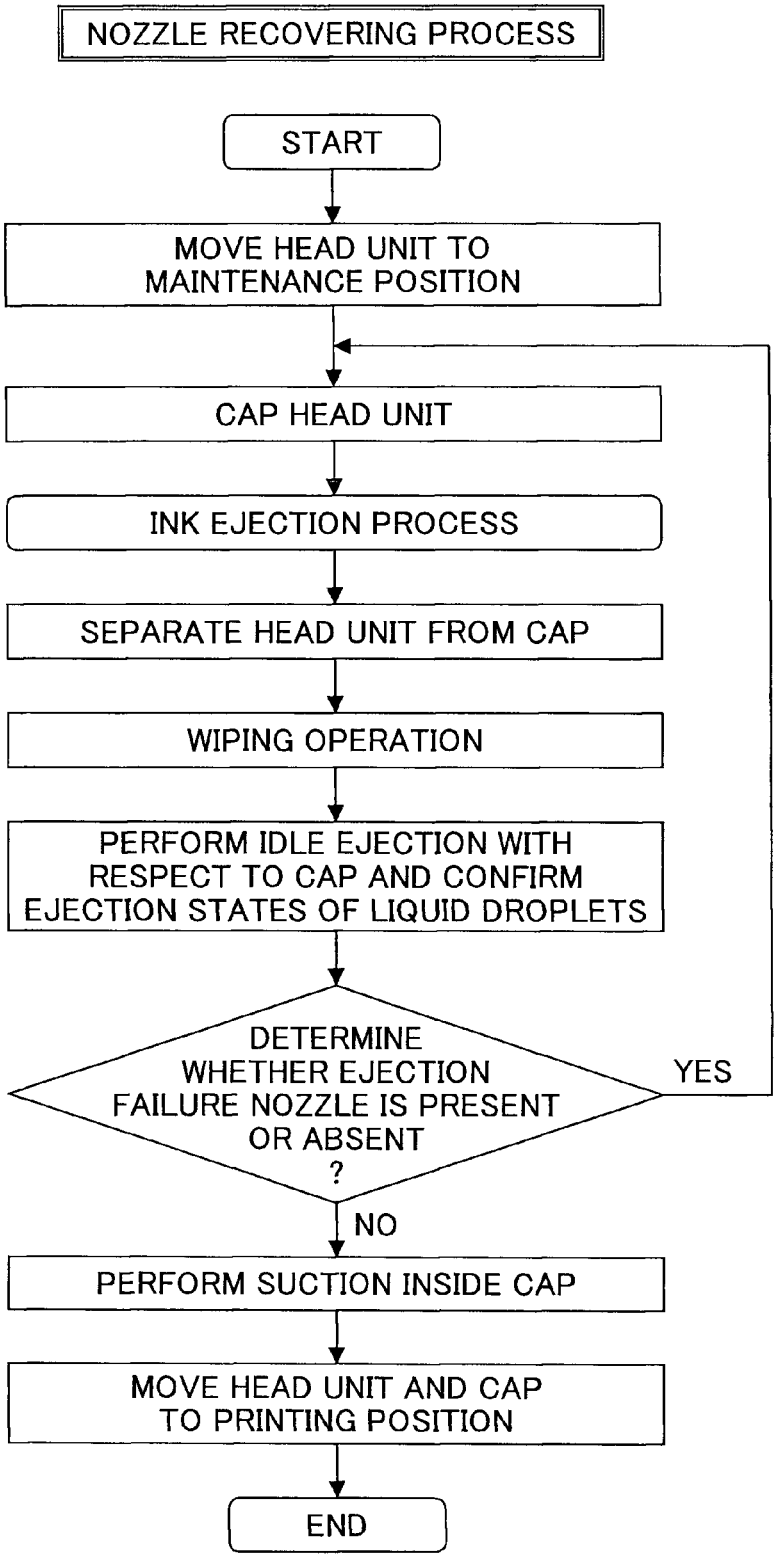
FIG. 12 is a flowchart for explaining a process from the printing process to a nozzle recovering process in the ink jet recording apparatus.

Next, referring to the flowchart of FIG. 12 and the illustrations of FIGS. 8A through 8H, a description is made of the nozzle recovering process after the printing operation is performed.

When the nozzle recovering process is started, the head units 11 move to the maintenance position (FIG. 8B) and the maintenance units 12 are put in the capping state (FIG. 8B→FIG. 8C→FIG. 8D). Then, a differential pressure is generated between the head units 11 and the maintenance units 12 via the head surfaces 100A so that ink is forcibly ejected from the liquid ejection heads 101. Subsequently, the liquid ejection heads 101 are separated from the caps 151 of the maintenance units 12 (FIG. 8E), and the wiping operation is performed on the head surfaces 100A of the head units 11 by the wiper blades 175 (FIG. 8E→FIG. 8F→FIG. 8G).

Then, the head units 11 move back to the capping position (FIG. 8D) where the ejection states of liquid droplets are detected (confirmed) by the liquid droplet detection device 324 while the idle ejection is performed with respect to the caps 151. Here, it is determined whether there is an ejection failure nozzle. If there is an ejection failure nozzle, the process is returned to the capping process performed by the caps 151 of the liquid ejection heads 101. On the other hand, if there is no ejection failure nozzle, the ink in the caps 151 is sucked and ejected, and the head units 11 and the maintenance units 12 move to the printing position (the position where the printing operation is performed) (FIG. 8C→FIG. 8B→FIG. 8H).

The forcible ejection of the ink may be performed on a liquid-ejection-head-basis or on a nozzle-basis. That is, this process is only necessary to be performed on a nozzle group including an ejection failure nozzle. The smaller the number of nozzles to be processed is, the smaller the amount of waste ink is generated. As a result, workloads causing a differential pressure can be reduced. Therefore, the ink is preferably ejected only from the ejection failure nozzle and its adjacent nozzles.

Figure 13:
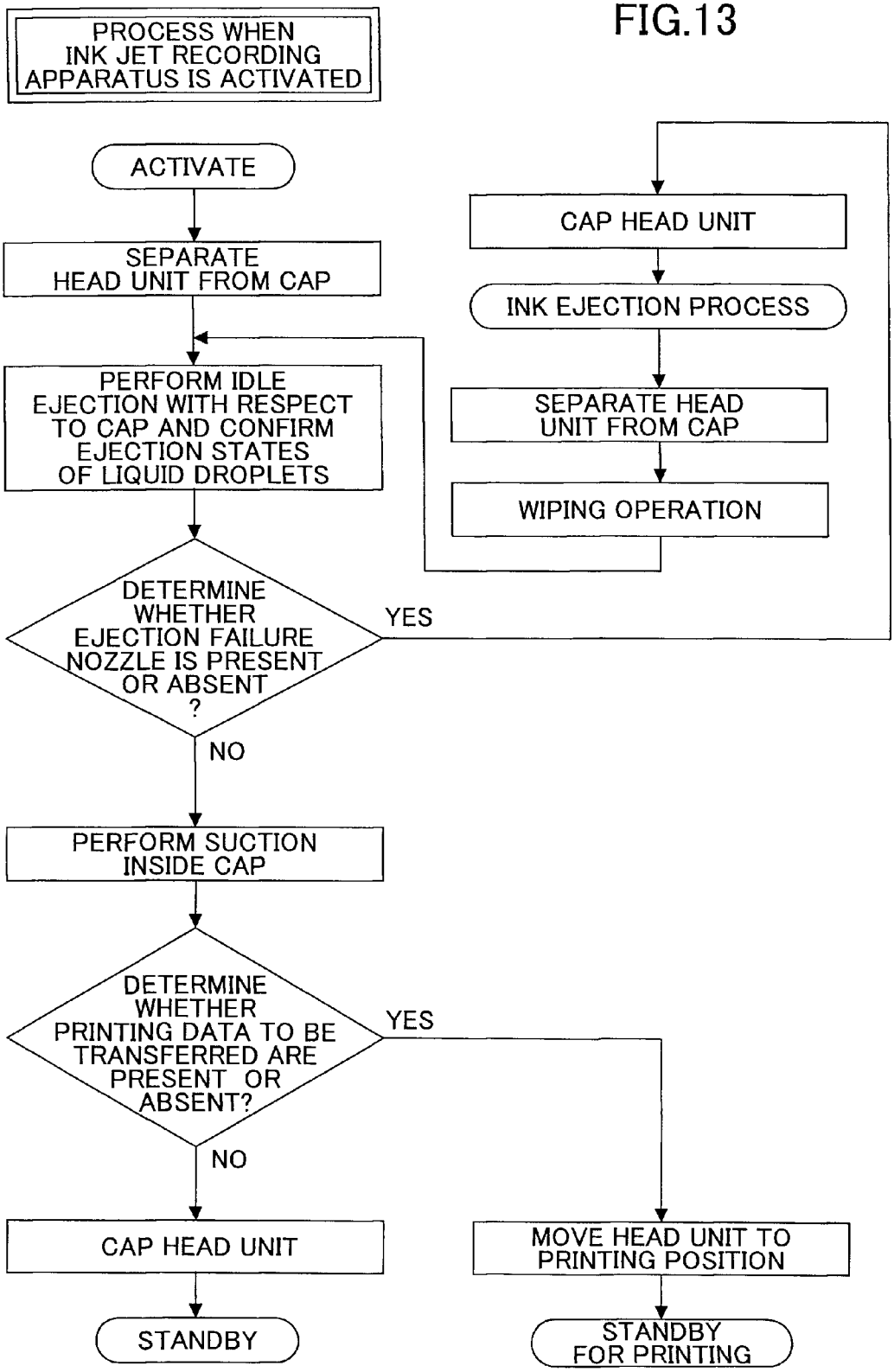
FIG. 13 is a flowchart for explaining a process when the ink jet recording apparatus is activated.

Such a process for detecting the ejection states of liquid droplets can be performed also when the ink jet recording apparatus is activated and terminated. Here, referring to the flowchart of FIG. 13 and the illustrations of FIGS. 8A through 8H, a description is made of the process when the ink jet recording apparatus is activated.

When the ink jet recording apparatus is activated, the head units 11 are separated (FIG. 8D→FIG. 8C) from the capping state (FIG. 8D), and the ejection states of liquid droplets are detected while the idle ejection is performed with respect to the caps 151. Here, it is determined whether there is an ejection failure nozzle. If there is an ejection failure nozzle, the liquid ejection heads 101 are capped (FIG. 8C→FIG. 8D) and caused to eject ink and separate from the maintenance units 12. Then, the liquid ejection heads 101 are subjected to the nozzle recovering process in which the head surfaces 100A of the head units 11 are wiped off. After this process, the ejection states of liquid droplets are confirmed again. If there is no ejection failure nozzle, suction inside the cap is performed. Then, if there are printing data to be transferred, the head units 11 move to the printing position and are on standby for the printing operation. If there are no printing data to be transferred, the liquid ejection heads 101 of the head units 11 are capped (FIG. 8C→FIG. 8D) and are on standby.

Figure 14:
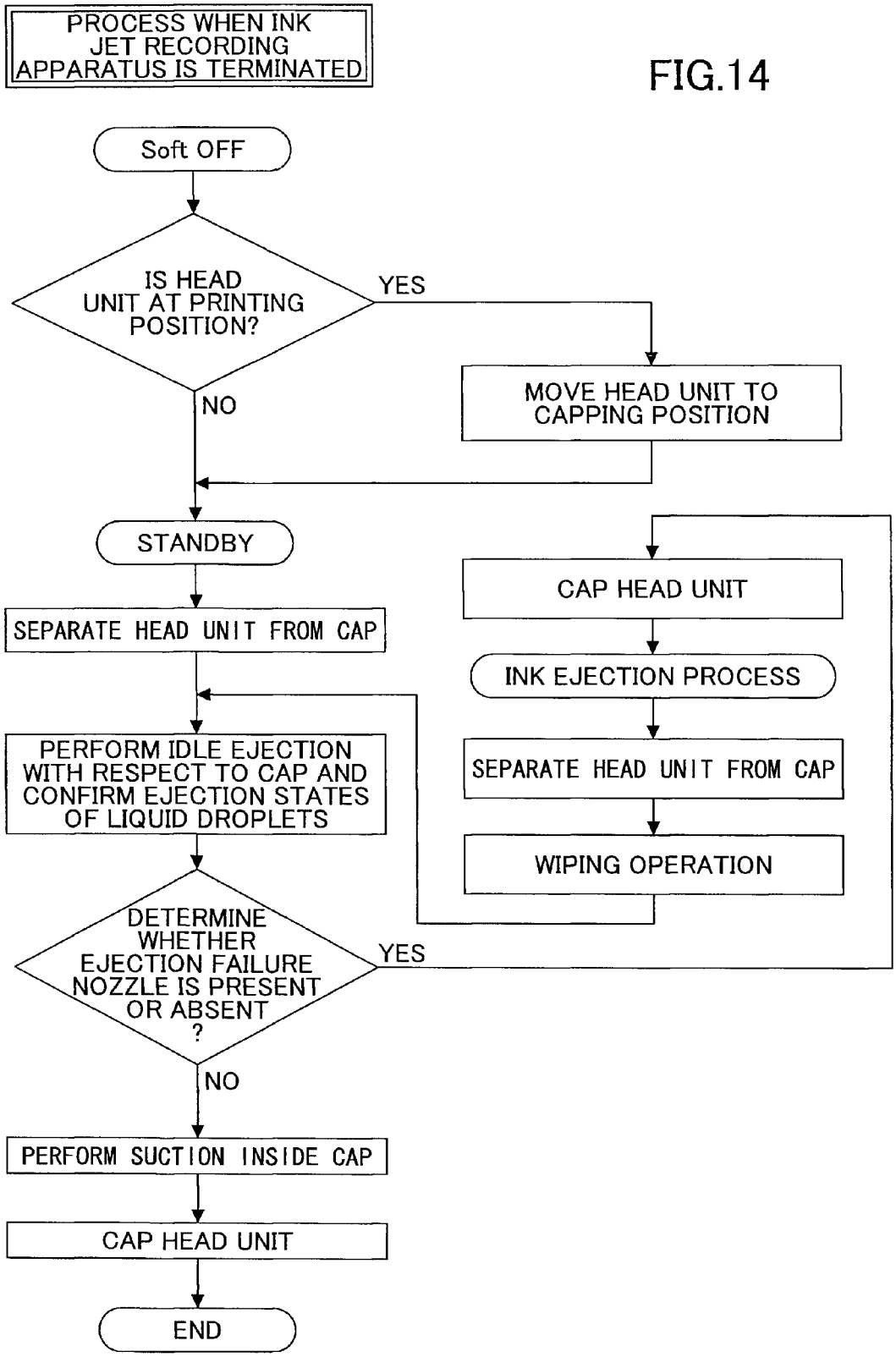
FIG. 14 is a flowchart for explaining a process when the ink jet recording apparatus is terminated.

Furthermore, referring to the flowchart of FIG. 14 and the illustrations of FIGS. 8A through 8H, a description is made of the process when the ink jet recording apparatus is terminated. When the ink jet recording apparatus is terminated, the head units 11 return to the standby state in accordance with a soft switch. The liquid ejection heads 101 of the head units 11 are separated from the caps 151 (FIG. 8D→FIG. 8C), and then the ejection states of liquid droplets are detected (confirmed) while the idle ejection is performed with respect to the caps 151. Here, it is determined whether there is an ejection failure nozzle. If there is an ejection failure nozzle, the nozzle recovering process as in the above example is performed, and then the ejection states of liquid droplets are confirmed again. On the other hand, if there is no ejection failure nozzle, suction inside the caps 151 is performed and the liquid ejection heads 101 of the head units 11 are capped (FIG. 8C→FIG. 8D). Then, the power of the ink jet recording apparatus is turned off.

Figure 15:
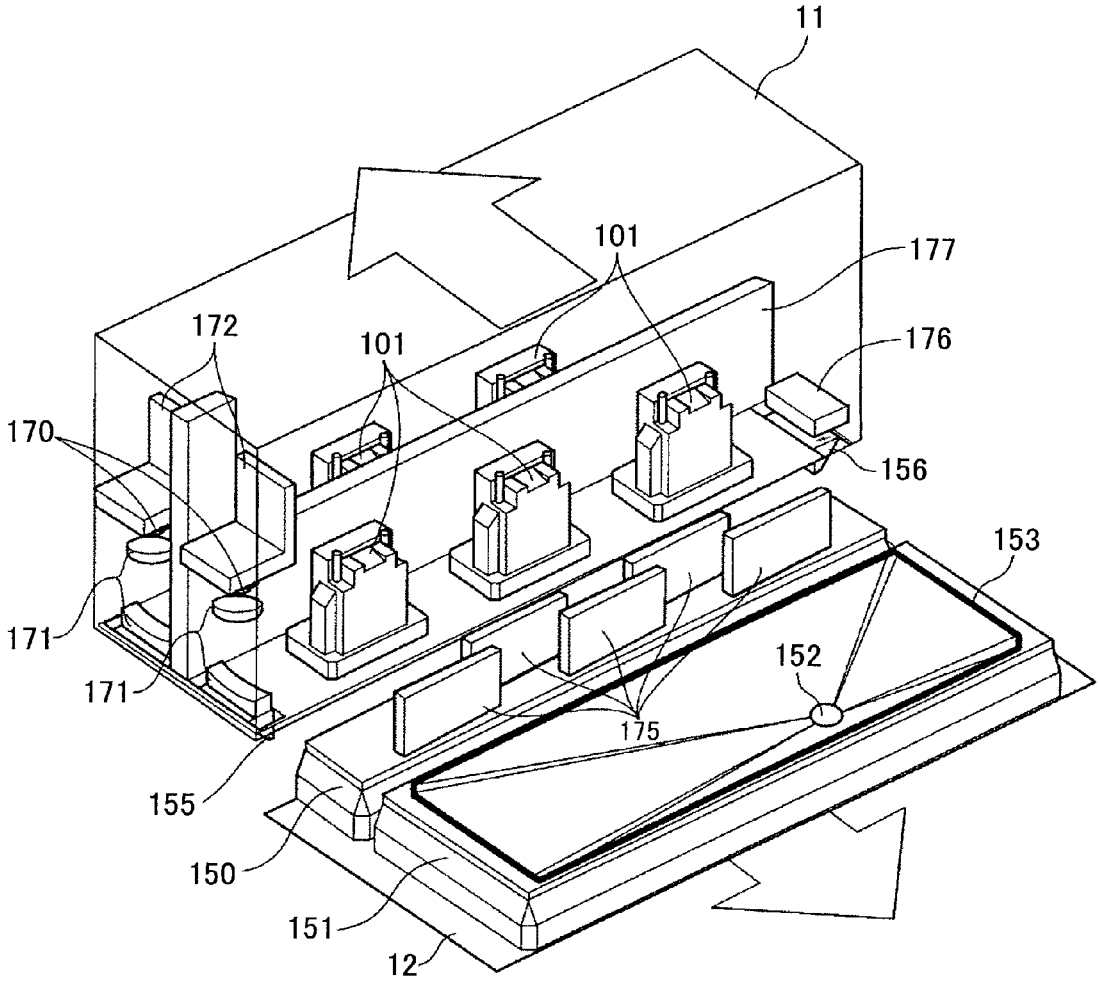
FIG. 15 is a perspective view of the head unit and a maintenance unit showing a first embodiment of a liquid ejection head unit according to the present invention.
Figure 16:
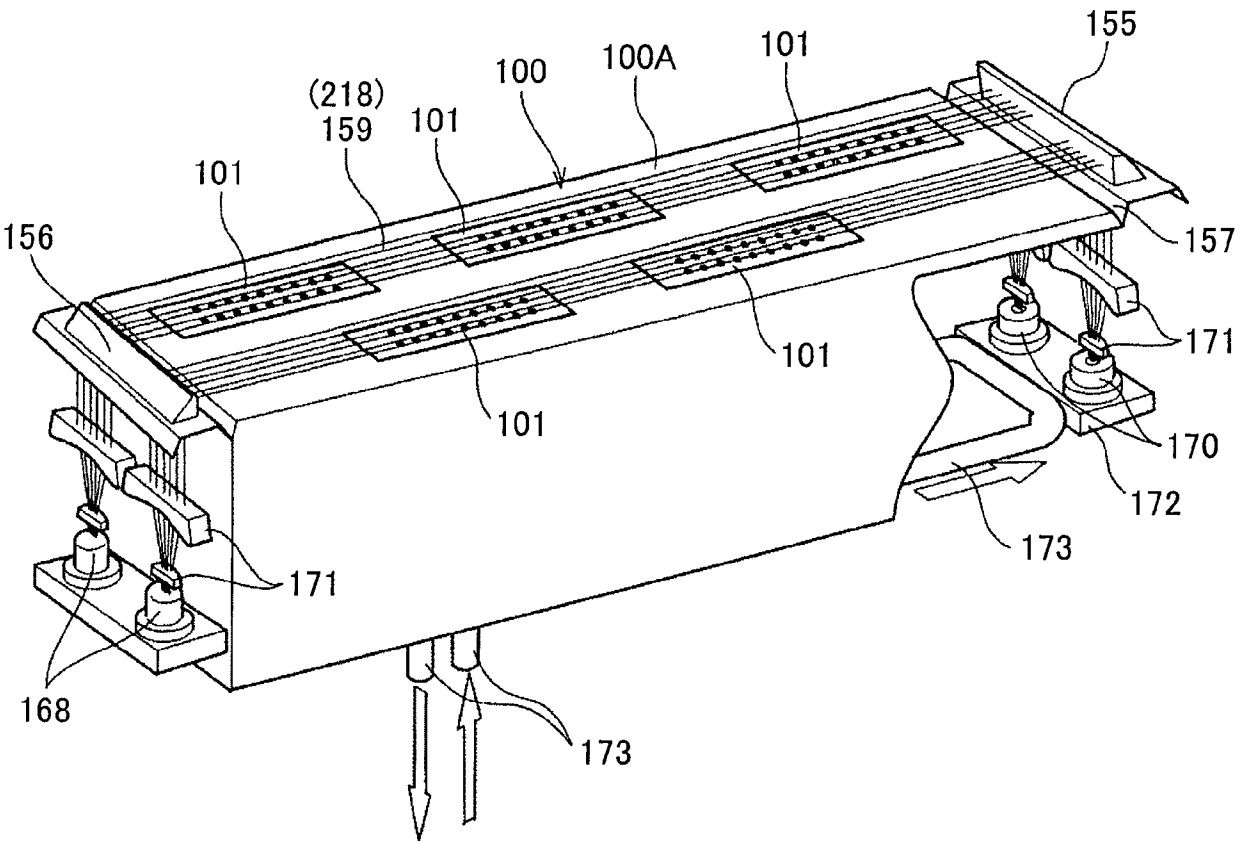
FIG. 16 is a perspective view of the head unit.
Figure 17:
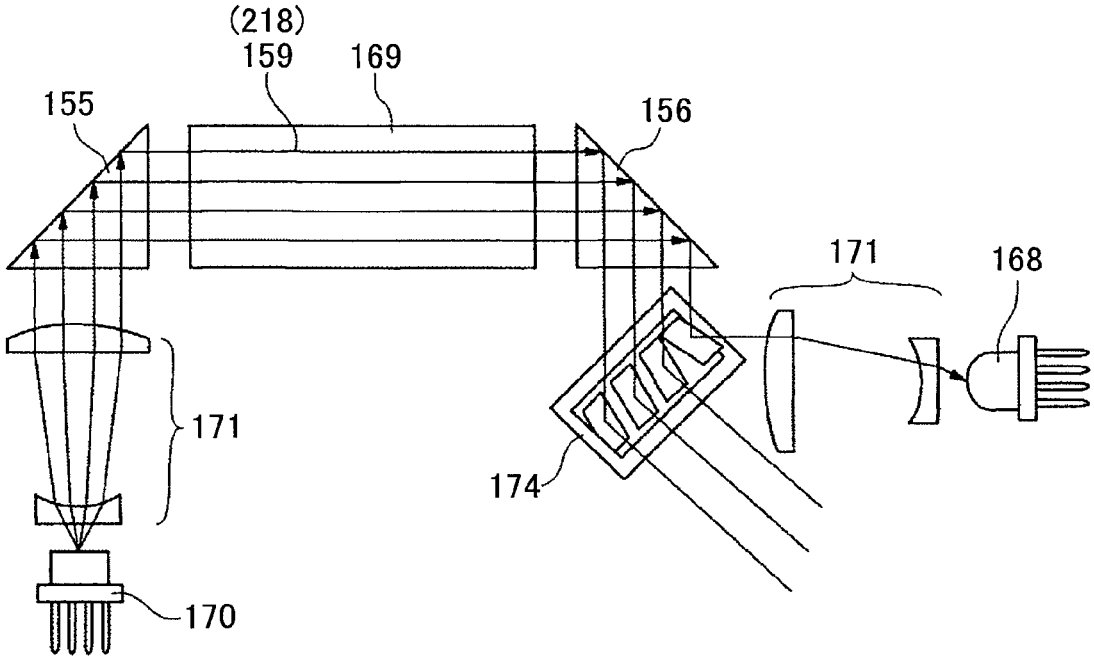
FIG. 17 is an illustration for explaining light paths of the liquid droplet detection device in the head unit.
Figure 18:
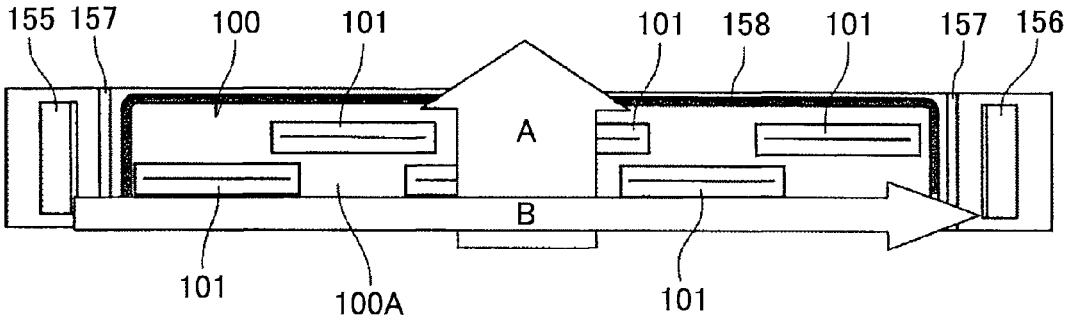
FIG. 18 is an illustration for explaining a relationship between the light path direction of the liquid droplet detection device and a wiping direction.
Figure 19:
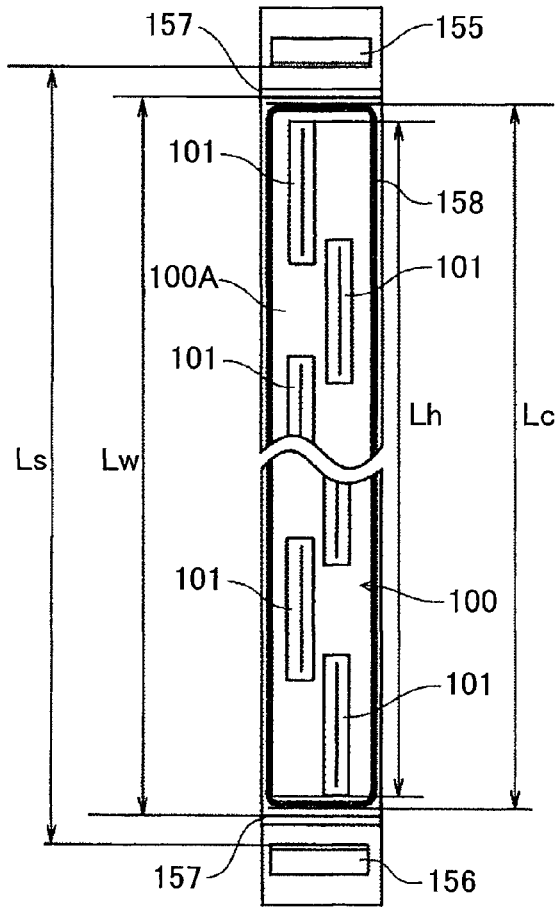
FIG. 19 is an illustration for explaining the dimensions of respective parts in the head unit.
Figure 20:
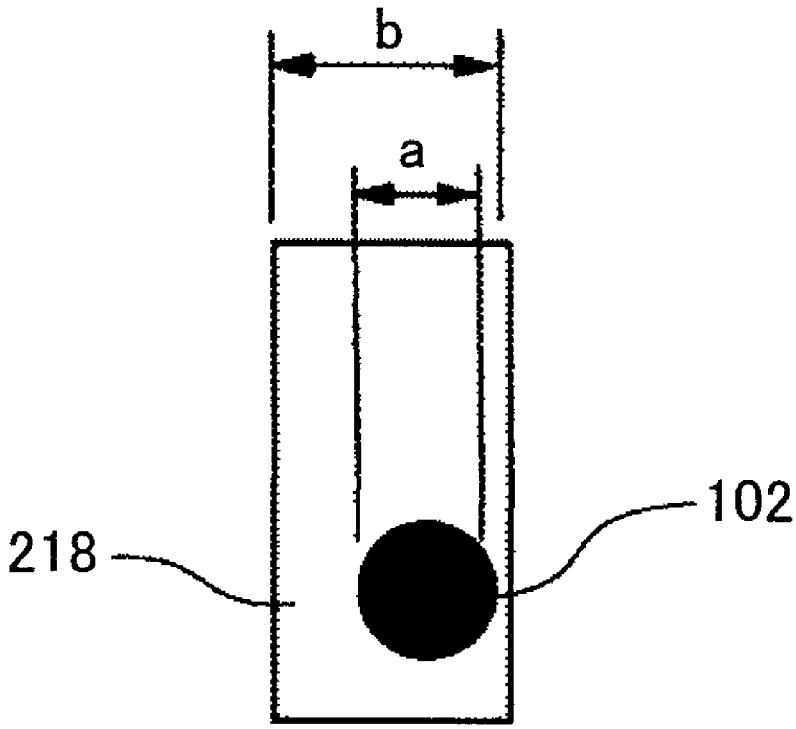
FIG. 20 is an illustration for explaining a relationship between a detection light beam of the liquid droplet detection device and a nozzle.

Next, referring to FIGS. 15 through 20, a description is made of a first embodiment of the liquid ejection head unit according to the present invention in the ink jet recording apparatus described above. Note that FIG. 15 is a perspective view of the head unit 11 and the maintenance unit, FIG. 16 is a perspective view of the head unit, FIG. 17 is an illustration for explaining light paths of the liquid droplet detection device in the head unit, FIG. 18 is an illustration for explaining a relationship between a light path direction of the liquid droplet detection device and a wiping direction, FIG. 19 is an illustration for explaining the dimensions of respective parts in the head unit, and FIG. 20 is an illustration for explaining a relationship between a detection light beam of the liquid droplet detection device and a nozzle.

As described above, the head unit 11 has the plural liquid ejection heads 101 supported on the head supporting member 100. In addition, the head unit 11 has the liquid droplet detection device 324 as a liquid droplet detecting unit that detects liquid droplets ejected from the liquid ejection heads 101. In other words, in the liquid ejection head unit 11 of this embodiment, the plural liquid ejection heads 101 and constituent members (a light-emitting unit, a light-receiving unit, and a light path forming unit) of the liquid droplet detection device 324 are integrated together.

The liquid droplet detection device 324 has laser diode arrays (hereinafter referred to as "LD arrays") 170 that are provided at one side surface in the longitudinal direction of the head unit 11 and serve as the light-emitting units that emits light beams in the embodiment of FIGS. 15-20, photo diodes 168 that are provided at the other side surface in the longitudinal direction of the head unit 11 and serve, in the embodiment of FIGS. 15-20, as the light-receiving units that receives the light beams emitted from the LD arrays 170, and the light path forming unit that causes the light beams emitted from the LD arrays 170 to pass through along the head surface 100A as detection light beams 218 from the outer side of an area that is capped by the cap 151 as a capping unit of the maintenance and recovery mechanism 12 of the image forming apparatus (i.e., from the outer side of a cap-nipping position 158 with which a cap-nipping part 153 comes into contact), and that causes the emitted light beams to be incident on the light-receiving unit provided at the outer side of the area. Note that the light-emitting unit 325 in FIG. 7 includes a driving circuit for the LD arrays 170, and the light-receiving unit 326 includes an output circuit for the photo diodes 168.

The light path forming unit is arranged at both one end part and the other end part in the longitudinal direction of the head unit 11. The light path forming unit is composed of a light-emitting mirror 155 and a light-receiving mirror 156 that fold light axes by 90 degrees; a beam expander 171 that expands distances between the light axes of the light beams (laser light beams) emitted from the LD arrays 170 so as to be formed into parallel light beams and makes the same incident on the light-emitting mirror 155; a beam expander 171 that narrows down the distances between the light axes of the parallel light beams from the light-receiving mirror 156 on which the laser light beams (detection light beams) 218 from the light-emitting mirror 155 are incident and makes the narrowed light beams incident on the photo diodes 168; and a digital micro mirror device 174 that selects one of the light paths as shown in FIG. 17. Note that light switching elements such as liquid crystal filters can be interposed on a light path between the LD arrays 170 and the photo diodes 168.

Here, the two LD arrays 170 and photo diodes 168 are provided so as to correspond to each row of the liquid ejection heads 101 of the head unit 11 and fixed and held on fixing plates 172 and 172. Accordingly, the laser light beams (detection light beams) 218 are caused to pass through above the nozzle surfaces 104 of the liquid ejection heads 101 in each row. The fixing plates 172 and 172 are attached to a wiring board 177 on which wirings for the LD arrays 170 and the photo diodes 168 are formed. Furthermore, the width "b" of the detection light beam 218 is set to be larger than the width "a" of the nozzle 102.

As shown in FIG. 17 describing the light paths in the head unit 11, the distances between the light paths of the laser light beams 218 emitted from the LD arrays 170 are expanded via the beam expander 171 to make the rows of the laser light beams 218 parallel to one another. After reflected by the light-emitting mirror 155, the laser light beams 218 pass through a detection area 169. Then, the laser light beams 218 are reflected by the light-receiving mirror 156. Following one of the light paths selected by the digital micro mirror device 174, the laser light beams 218 are caused to be incident on the photo diodes 168 via the beam expander 171.

With this configuration, when the ejection states of liquid droplets from the heads 101 of the head unit 11 are detected, the LD arrays 170 are driven to emit the laser light beams 218. Accordingly, the laser light beams 218 are caused to pass through above the nozzles 102 of the heads 101 along the head surface 100A via the beam expander 171 and the light-emitting mirror 155 and to be incident on the photo diodes 168 via the light-receiving mirror 156 and the digital micro mirror device 174. At this time, when the laser light beams 218 come into contact with the liquid droplets ejected from the heads 101 in the detection area 169 shown in FIG. 17, scattering and absorbing of the laser light beams 218 occur at points where the laser light beams 218 come into contact with the liquid droplets. In this case, the amount of the light beams reaching the photo diodes 168 is reduced compared with a case where the laser light beams 218 do not come into contact with the liquid droplets. Therefore, it is possible to determine the presence or absence of the liquid droplets on the light paths through the comparison of the output voltage of the photo diodes 168 with a predetermined threshold.

Thus, with the provision of the light-emitting unit that emits the light beams, the light-receiving unit that receives the light beams emitted from the light-emitting unit, and the light path forming unit that causes the light beams emitted from the light-emitting unit to pass through along the nozzle surface on the outer side of the area capped by the capping unit and that causes the light beams to be incident on the outer side of the area, it is possible for the liquid droplet detection unit to detect the liquid droplets ejected from the heads with a simple configuration without moving the head and without interrupting the capping of the head.

Note that with the provision of the LD arrays 170 as the light-emitting unit, it is possible to provide many light axes in a small space and facilitate the accommodation of the light axes in the head unit 11. Furthermore, because even narrow light-axes distances can be arranged on the arrays 170 corresponding to the pitches between the nozzles, it is not necessary to design complicated light paths.

Further, at its both ends in the longitudinal direction, the head unit 11 has grooves 157 and 157 between the light-emitting mirror 155 and the light-receiving mirror 156 each eking being a part of the light path forming unit and the head surface 100A. Accordingly, it is possible to prevent ink, etc., adhering to the head surface 100A from moving to the light-emitting mirror 155 and the light-receiving mirror 156 and soiling the same causing the degradation of detection precision.

Moreover, the heat generated from the LD arrays 170 is transmitted to a LD fixing plate 172 and comes into contact with refrigerant piping 173, which in turn performs heat exchange. The refrigerant piping 173 is connected to the outside of the head unit 11 and serves to transfer waste heat of the LD arrays 170 outside the head unit 11. As the refrigerant, the ink for use in the printing operation may be used. Accordingly, the configuration of a liquid circulation is simplified and common to the side of the ink, thereby making it possible to reduce costs and the number of driving components such as a pump and improve reliability.

Next, referring to FIG. 15, a description is made of a relationship between the head unit 11 and the maintenance unit 12. As described above, the maintenance unit 12 has the cap 151 and the wiper blades 175. The cap 151 has the cap-nipping part 153 that comes into contact with the head surface 100A of the head unit 11 to hermetically seal the same and has an ejection port 152 that ejects waste ink to the side of the sucking unit. Furthermore, the wiper blades 175 are held on a wiper holder 150. Here, in order to separately wipe off the heads 101, the wiper blades are provided by the number corresponding to the heads 101.

As described above, the head unit 11 performs the operations, such as the capping, the ejection of ink, and the wiping in the nozzle recovering process. In this case, the head unit 11 may be moved in the direction as indicated by the arrow, or the maintenance unit 12 may be moved in the direction as indicated by the arrow in FIG. 15. In other words, the head unit 11 and the maintenance unit 12 are moved relative to each other to perform the wiping operation. Accordingly, the wiping operation is performed, for example, in such a manner that the wiper blades 175 are slid in the direction as indicated by the arrow A shown in FIG. 18. At this time, the direction of light paths for detecting liquid droplets is the direction as indicated by the arrow B in which the sliding direction of the wiper blades 175 is orthogonal to light axes.

Under the movements of the wiper blades 175 in this manner, waste ink is less likely to adhere to optical parts (the light-emitting mirror 155 and the light-receiving mirror 156 in FIG. 17), thereby making it possible to suppress the reduction of sensitivity due to ink adhesion. Furthermore, with the provision of the grooves 157 between a head peripheral member 160 and the optical parts, it is possible to stop the flowing of ink leaking from the ends of the wiper blades 175 to the optical parts during the sliding of the wiper blades 175 and to reduce stains on the optical parts.

Here, referring to FIG. 19, a description is made of a relationship between the arrangement positions of the light-emitting mirror 155 and the light-receiving mirror 156 and the cap-nipping position 158 (the part which the cap-nipping part 153 comes into contact with).

In the head unit 11, the length Lc of the cap-nipping position 158 is set to be larger than the head arrangement length Lh of the head unit 11 so that waste ink ejected from the heads 101 fall within the cap 151. Furthermore, in order to remove ink adhering to the cap-nipping part 153 of the cap 151, adhesion ink is transferred to the head unit 11 in accordance with the capping operation and then wiped off by the wiping operation. Therefore, the length Lw of the wiping area wiped off by the wiper blades 175 is set to be larger than the length Lc of the cap-nipping area.

Moreover, the light path length Ls of the detection area 169 between the optical parts is set to be larger than the head arrangement length Lh so as to completely cover the nozzles 102 and set to be larger than the length Lc of the cap-nipping area so as not to be an obstacle to the cap 151 and so as to prevent the optical parts from being stained by ink at the time of the capping and the ejection of ink. Furthermore, the optical parts (the light-emitting mirror 155 and the light-receiving mirror 156) project from the head surface 100A. Therefore, if the optical parts exist in the wiping area, they would be obstacles to the sliding of the wiper blades 175. That is, in order to improve wiping performance, the light path length Ls of the detection area 169 is set to be larger than the length Lw of the wiping area.

Figure 21:
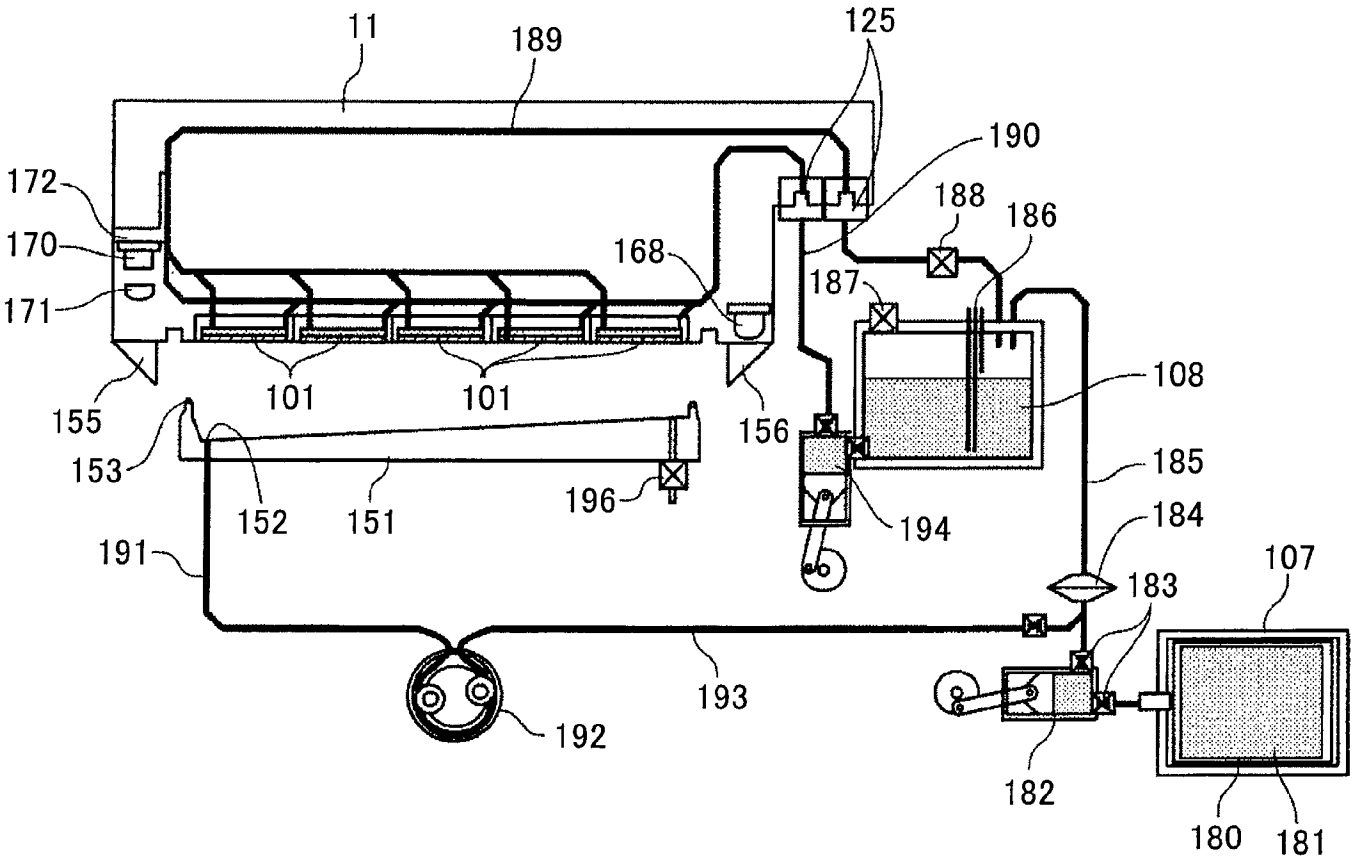
FIG. 21 is a schematic view for explaining an ink supplying system of an apparatus having the head unit.

Next, referring to FIG. 21, a description is made of ink paths of an ink jet apparatus using the head unit 11.

First, as shown in FIG. 21, an ink cartridge 107 is composed of a cartridge case 180 and an ink bag 180 having ink stored therein. When the ink cartridge 107 is attached to the ink jet apparatus, an ink supplying path of the ink bag 181 is communicated with that of the ink jet apparatus. Because the ink is put in an inner bag, it is isolated from air, thereby making it possible to prevent oxidation and degradation and air from dissolving in the ink. However, it is also possible to provide a cartridge with an air communication channel through which the ink is directly put into the cartridge.

The ink is supplied from the ink cartridge 107 to a sub-ink tank 108 by a supply pump 182 and stored in it. When the ink is caused to pass through an ink filter 184 in the path from the ink cartridge 107 to the sub-ink tank 108, coarse particles causing an ejection failure of the ink can be filtered. Therefore, ejection reliability can be improved. As the supply pump 182, general liquid feeding pumps such as diaphragms and tubing pumps are available. However, the supply pump 182 is not particularly limited so long as its members are not eroded to be swelled or dissolved. Furthermore, the ink filter 184 is preferably a mesh of 20 μm or smaller and particularly preferably a mesh of 10 μm or smaller. However, an excessively-small mesh causes large resistance, thereby increasing liquid feeding loads of the supply pump 182.

The ink supplied to the sub-ink tank 108 comes into contact with sensor electrodes 186. Through the measurement of the conductivity between the electrodes 186, it is determined whether the amount of the ink in the sub-ink tank 108 is a specified value. If the amount of the ink exceeds the specified value, this status is informed from the I/O 322 of the controlling unit 300 to the CPU 301. Then, the feeding liquid suction motor driving controlling unit 316 stops the ink supplying motor 318 to stop the supply pump 182. As a result, the supply of the ink is stopped. Accordingly, a certain amount of the ink can be maintained in the sub-ink tank 108.

Note that the sensor electrodes 186 may be any of a first-level type composed of two sensor electrodes, a second-level type composed of three sensor electrodes, and a multiple-level type that can determine multiple levels. Besides the method using the electrodes, the amount of liquid in the sub-ink tank 108 can be detected using a sensor for evaluating the level of liquid in accordance with an optical method using the light transmission characteristics and the refractive index of ink, a method using capacitance, an magnetic detection method in which a float and a magnet are combined together.

Furthermore, when liquid is taken out and put in the sub-ink tank 108, such as cases where the ink is supplied from the ink cartridge 107 to the sub-ink tank 108 or where printing operations are performed, a sub-ink tank atmospheric opening valve 187 provided in the sub-ink tank 108 is opened to maintain the pressure inside the sub-ink tank 108 at atmospheric pressure.

The ink is fed from the sub-ink tank 108 to the heads 101 via a supplying path 190 and connected to common liquid chambers of the heads 101. In the structure of the head unit 11, a negative pressure is applied from the sub-ink tank 108 to the heads 101 either by an automatic manner using a water head or by an active manner using a valve or a pump, so that a pressure of the surface tension or greater is naturally applied to prevent the ink from leaking out the heads 101. Furthermore, because the ink has to be supplied in accordance with the printing and maintenance operations, the supplying path 190 requires a pipe area having an ink-supplying capability enough to deal with even a maximum use amount of the ink.

Furthermore, with the provision of a liquid feeding pump 194 that supplies the ink from the sub-ink tank 108 to the heads 101 and an ink returning path 189 through which the ink is returned from the heads 101 to the sub-ink tank 108, the ink of the head unit 11 can be circulated. Through the circulation of the ink, air bubbles causing an ejection failure can be ejected from the heads 101. Furthermore, with the LD fixing plate 172 coming into contact with the ink returning path 189, it is possible to eject from the head units 11 the waste heat from the LD arrays 170, which is generated to detect the ejection of liquid droplets.

Although not shown in the figures, the ink supplied to the heads 101 is moved from the common liquid chambers to separate liquid chambers as is generally known and then ejected as liquid droplets from the nozzles 102 at the ends of the separate liquid chambers by the pressure of a pressure generating unit.

In order to make the head unit 11 detachable, the head unit 11 is connected to the ink path via ink tube joints 125. In the ink tube joints 125, the ink is sealed by a gasket made of an elastic member having an ink-resistant property. Accordingly, the leakage of the ink from a connection part between the head unit 11 and the ink path is prevented.

When the ink is ejected from the head 101 as the maintenance operation, the cap-nipping part 153 opposing the heads 101 and made of an elastic member is arranged so as to be closely attached to the head surface 100A of the head unit 11 so that the ink falls within the cap 151. The ink fallen within the cap 151 is sucked and ejected to a suction path 191 connected to a suction pump 192 via a cap suction port (ejection port) located on the downstream side of the cap 151.

At the time of a sucking operation, the suction pump 192 rotates to eject the ink to a circulation path 193. After subjected to the ink filter 184 again to remove its coarse particles, the ejected ink is returned to the sub-ink tank 108 again.

The cap 151 has an atmospheric opening valve for opening the pressure inside the suction path 192 at the time of the sucking operation. In addition, the atmospheric opening valve can also be used for eliminating the liquid of the suction path 192.

In assembling the head unit 11, it is important to align a liquid droplet detection part with a liquid droplet ejection part. Therefore, it is preferable that the optical parts be aligned while they are assembled into the head unit 11 after the optical parts and the liquid droplet ejection part of the head unit 11 are separately assembled. Only with the assembling of the optical parts, the light-emitting unit, the lenses, and the mirrors can be assembled together, while maintaining their positional relationship with high precision. Accordingly, it is possible to improve cleanness in assembling the optical parts compared with a general assembling process.

Furthermore, as for the head unit 11 in which the heads 101 are put together, the assembling alignment of the heads 101 is important. Using a common member for the alignments of the light-emitting part and the assembling of the heads 101, it is possible to improve precision in the alignment positions of constituent members of the head unit 11.

Figure 22:
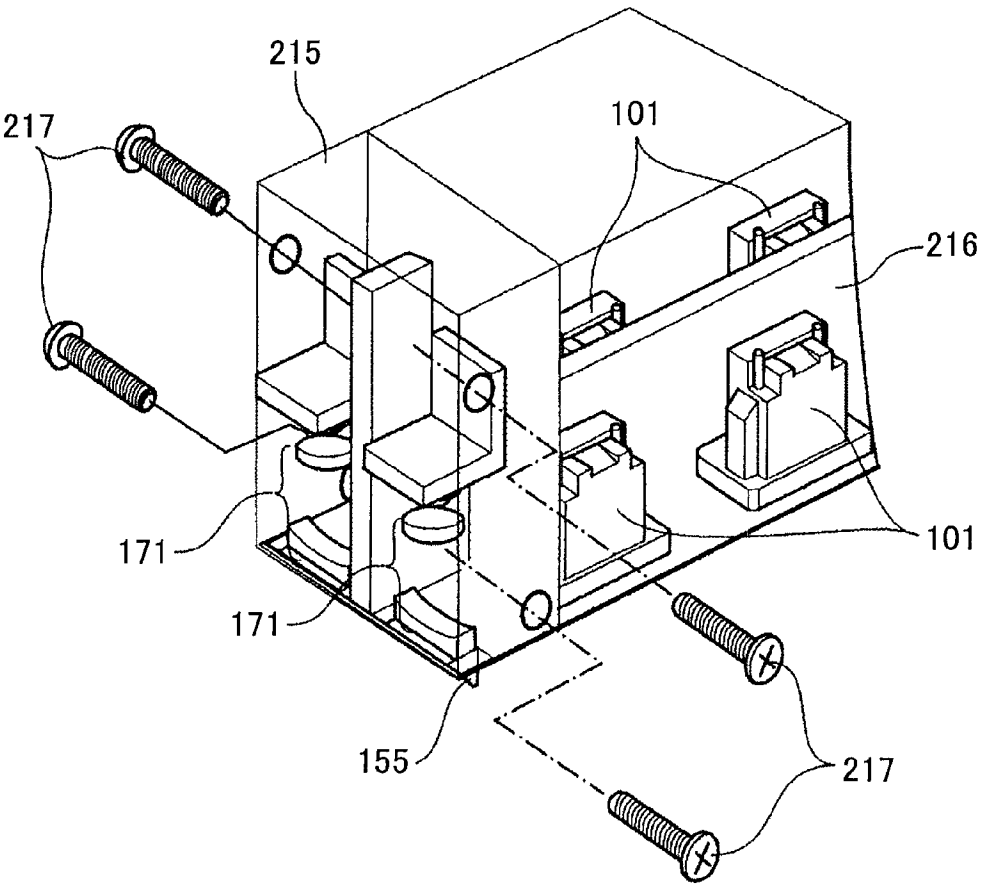
FIG. 22 is a perspective view for explaining a method of assembling the head unit.
Figure 23:
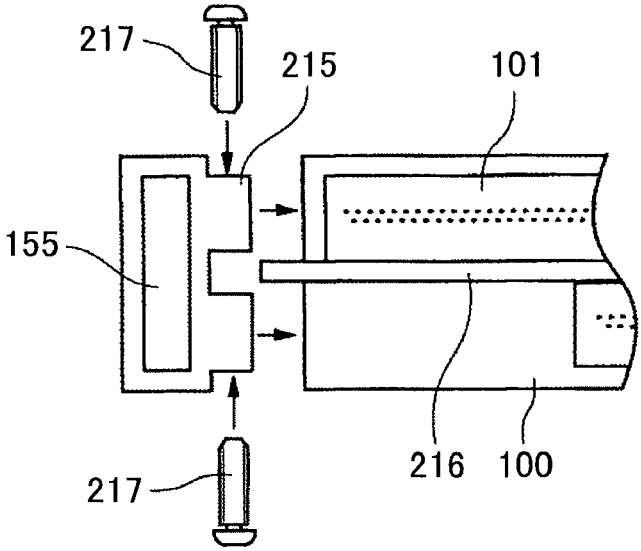
FIG. 23 is a schematic plan view of a substantial part of the head unit for explaining the method.
Figure 24:
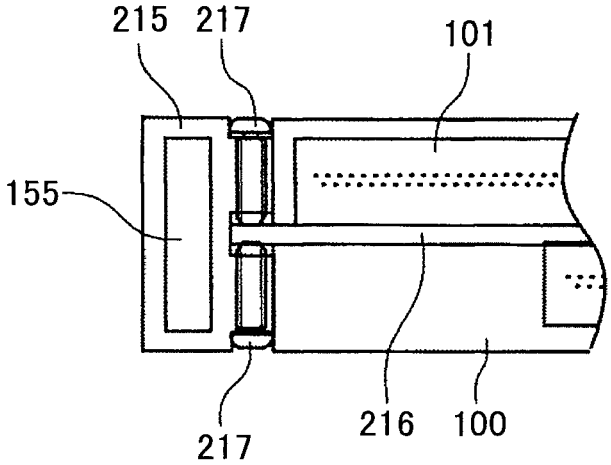
FIG. 24 is a schematic plan view of the substantial part of the head unit for explaining the method.

Here, referring to FIGS. 22 through 24, a description is made of a method of assembling the head unit 11. Note that FIG. 22 is a perspective view for explaining the method, and FIGS. 23 and 24 are schematic plan views of a substantial part of the head unit 11 for explaining the method.

First, the heads 101 are assembled into a reference member 216 of the head unit 11 in its width direction so as to be pressed against, thereby ensuring precision with respect to the reference member 216 and constituting the liquid droplet ejection part. Then, a sensor unit 215 as the optical part is united with the liquid droplet ejection part while pressed in the longitudinal direction of the liquid droplet ejection part, and fixed to the reference member 216 with its position adjusted by adjustment screws 217 (FIG. 24).

After the sensor unit 215 is united with the liquid droplet ejection part, fine adjustment is made so that the light paths and the nozzle arrays are properly positioned. That is, the sensor unit 215 is adjusted by the adjustment screws 217 to align the light paths with the nozzle arrays. When the adjustment of the sensor unit 215 is made by the four adjustment screws as shown in FIG. 22, it is possible to adjust the parallel movement and the twisted direction of the sensor unit 215 relative to the reference member 216 and increase the degree of freedom in movements of members. Therefore, the adjustment of the members is facilitated.

Furthermore, after the adjustment of the sensor unit 215, a slight error may occur due to an impact generated, for example, when the sensor unit 215 is united with the reference member 216. It is preferable that the width of the detection light beam 218 be larger than the diameter of the nozzle 102 as described above to prevent a detection error and be two times or larger than the diameter of the nozzle 102 to allow for such a slight error.

With the provision of the adjustment units, it is possible to easily adjust the light axes when the head unit 11 is assembled. Furthermore, the adjustment of the light axes is not required at the time of assembling the head unit 11 into the ink jet apparatus because it is completed only by the head unit 11. Therefore, uniting workability of the ink jet apparatus is improved. Moreover, because it is possible to replace only the head unit 11 without having a special function of adjusting the light axes, an improvement in maintenance and the simplification of the ink jet apparatus can be realized.

Figure 25:
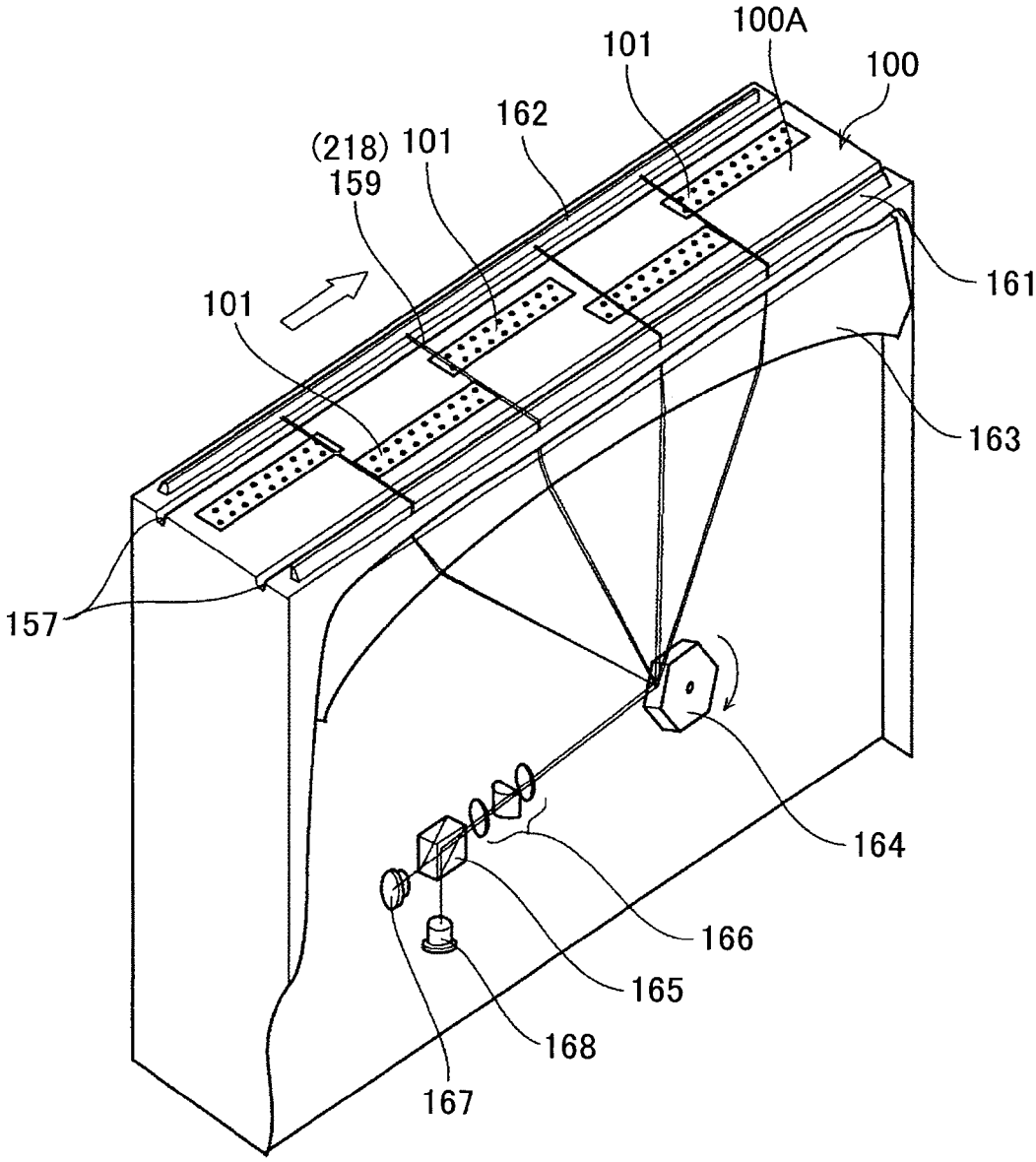
FIG. 25 is a perspective view of a second embodiment of a liquid ejection head unit according to the present invention.
Figure 26:
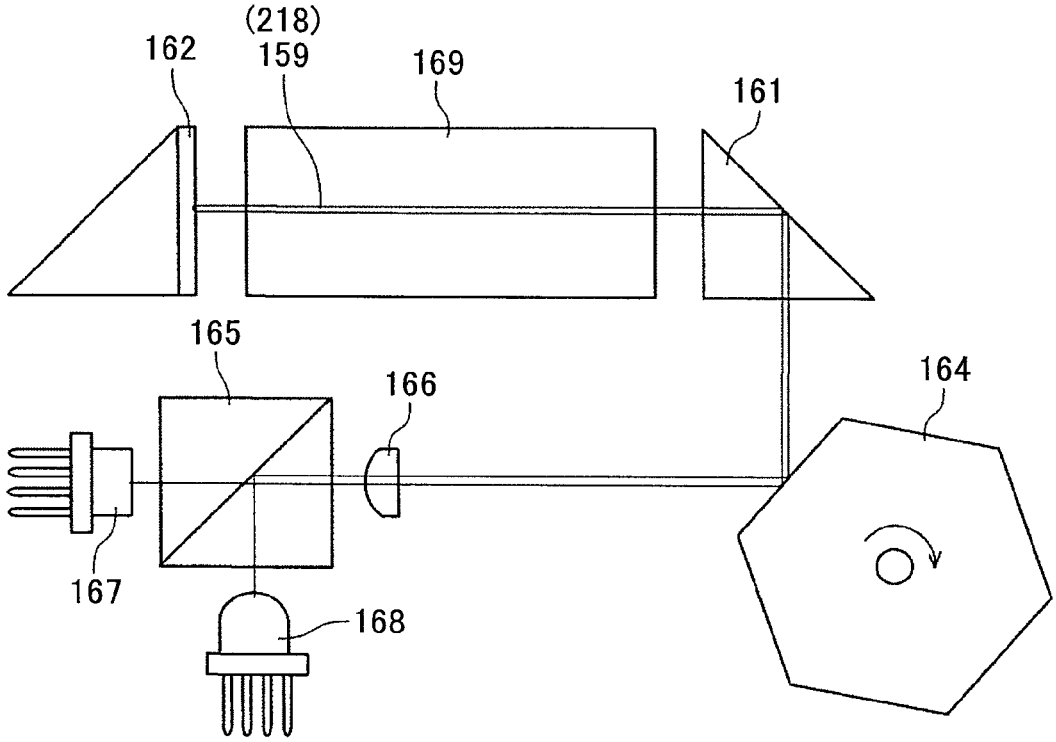
FIG. 26 is an illustration for explaining the light path of the head unit.
Figure 27:
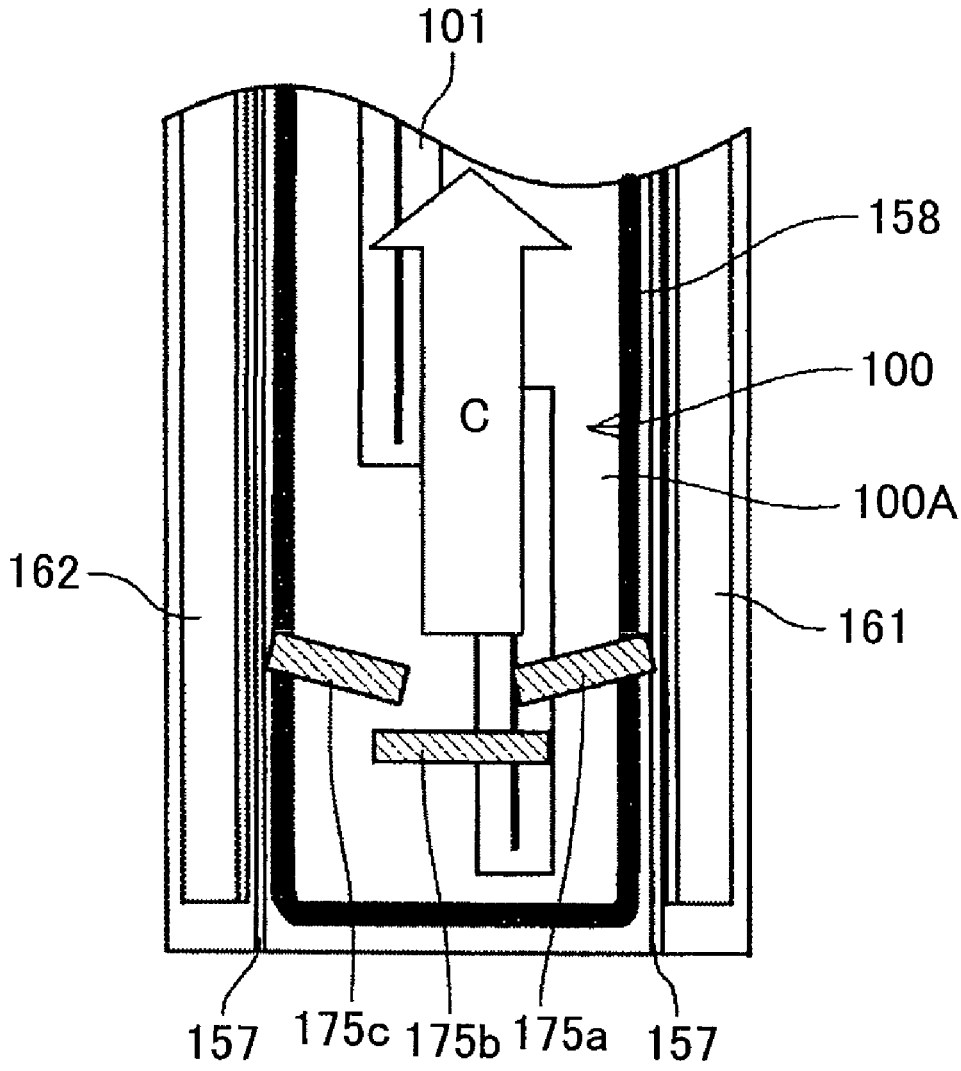
FIG. 27 is a plan view of a substantial part of the head unit for explaining a wiping direction.
Figure 28:
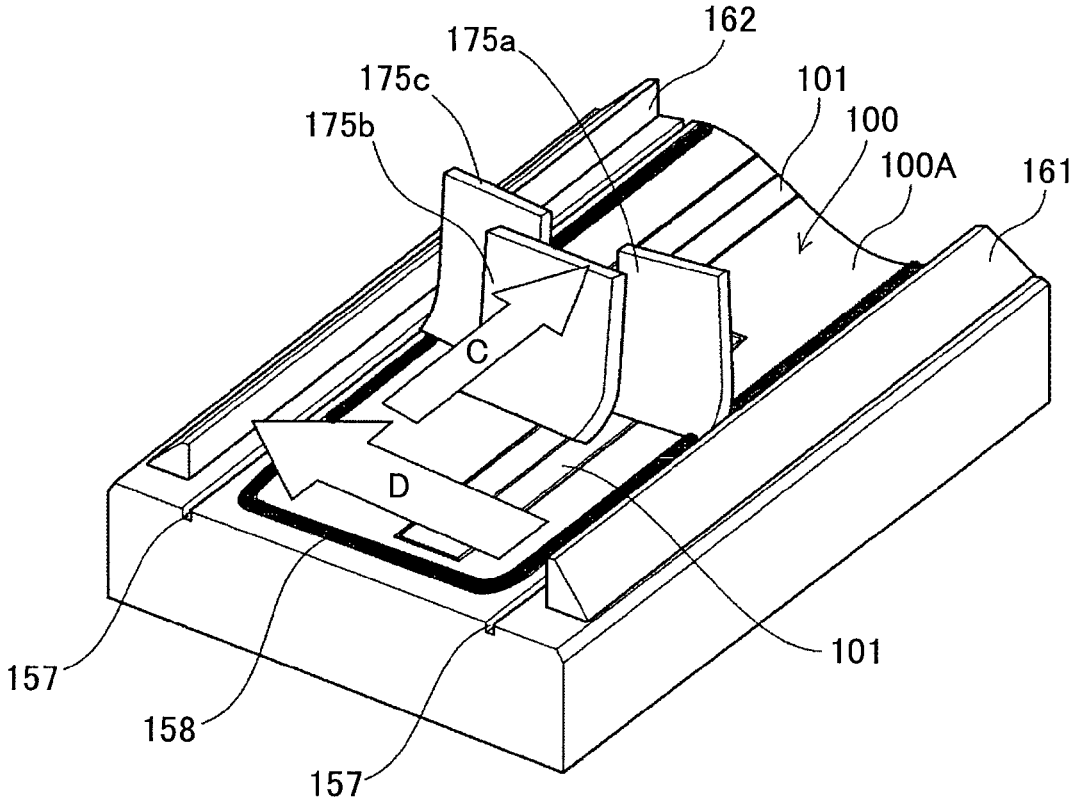
FIG. 28 is a plan view of the substantial part of the head unit for explaining a relationship between the wiping direction and the direction of a light axis.
Figure 29:
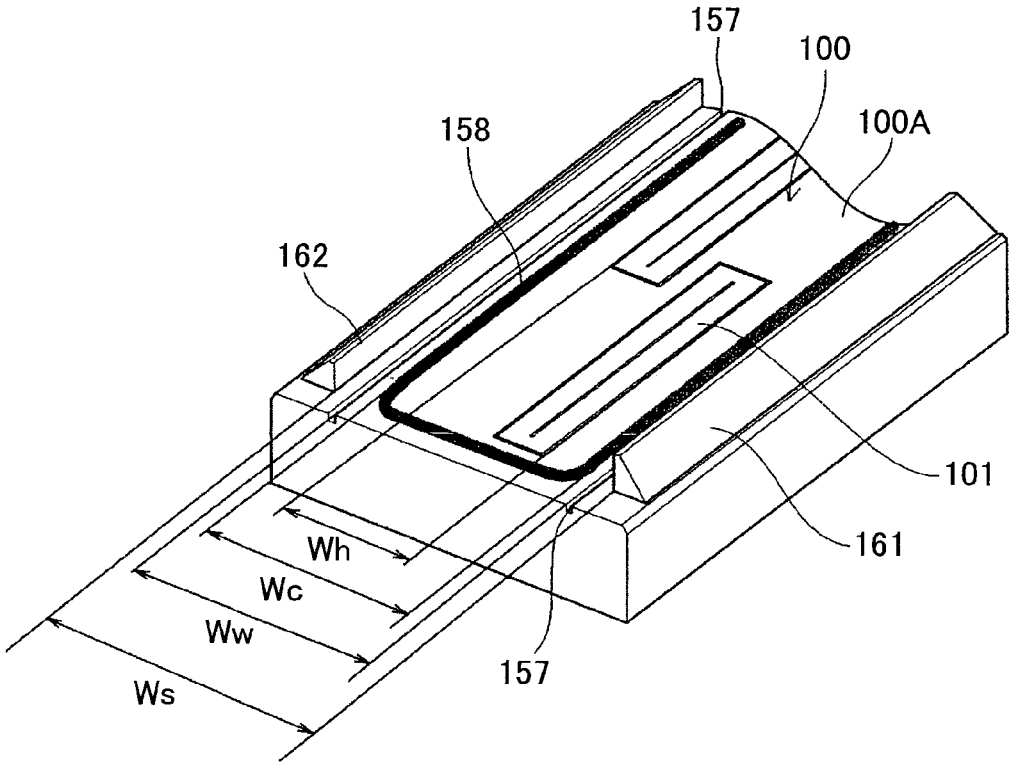
FIG. 29 is an illustration for explaining a dimensional relationship between parts of the head unit.

Next, referring to FIGS. 25 through 29, a description is made of a second embodiment of the liquid ejection head unit according to the present invention. Note that FIG. 25 is a perspective view of the head unit, FIG. 26 is an illustration for explaining the light path of the head unit, FIG. 27 is a plan view of a substantial part of the head unit for explaining the wiping direction, FIG. 28 is a plan view of the substantial part of the head unit for explaining a relationship between the wiping direction and the direction of the light axis, and FIG. 29 is an illustration for explaining a dimensional relationship between parts of the head unit.

In the head unit 11, the plural heads 101 are arranged side by side in a two-row head supporting member 100, and grooves 157 similar to those described above are formed at both ends in the width direction of the supporting member 100.

Because a light-emitting/light-receiving mirror 161 for folding a light axis by 90 degrees and a reflection mirror 162 having the same normal direction relative to the light axis are arranged on the outer side of the grooves 157, they are placed on the outer sides of the cap-nipping area. On the side of the light-emitting/light-receiving mirror 161 are arranged a laser diode (LD) 167 as a light-emitting unit and a photo diode 168 serving not only as a scanning unit (the light axis deflecting unit 327) that arbitrarily folds the light axis with a polygon mirror 164 and aligning the same with the nozzle surface 101A with an f-θ lens 163 and but also as a light-receiving unit arranged at a surface different from the LD 167 of a beam splitter 165. The LD 167 and the photo diode 168 constitute a liquid droplet detection unit (device).

The light path of the liquid droplet detection unit in the head unit 11 is schematically shown in FIG. 26. That is, a laser light beam emitted from the LD 167 is incident on a collimator lens 166 via a beam splitter 165, which makes a luminous flux being a parallel light beam. After passing through the light path folded by the polygon mirror 164, the laser light beam is incident on the light-emitting/light-receiving mirror 161 via the f-θ lens 163. The light axis of the laser light beam is folded so that the light beam passes through the detection area 169 as the detection light beam 218. After passing through the detection area 169, the detection light beam 218 is reflected by the reflection mirror 162 to trace the same light path in reverse order. Following the light axis switched by the beam splitter 165, the laser light beam is incident on the photo diode 168.

Note that the light axis in the forward path is slightly different from that in the backward path due to the movements of the polygon mirror 164. That is, the light path from the polygon mirror 164 to the photo diode 168 in the backward direction is not parallel to that from the polygon mirror 164 to the photo diode 168 in the forward direction. Therefore, with the provision of a correction unit that corrects the light path and of a condensing lens before the photo diode 168, it is possible to improve detection efficiency.

When the detection light beam 218 comes into contact with liquid droplets in the detection area 169, scattering and absorbing of the laser light beam (detection light beam) 218 occur at points where the laser light beam 218 comes into contact with the liquid droplets. Similarly, they also occur in the backward light path. Therefore, the amount of the light beam reaching the photo diode 168 is further reduced. As a result, a S/N ratio increases, thereby improving the sensitivity to the laser light beam.

With the collective arrangement of the light-emitting unit and the light-receiving unit on one side, it is possible to provide a room for the layout of the head unit 11 and use the optical parts in common between the forward light path and the backward light path. Therefore, it is possible to attain the reduction of the number of parts, an improvement in precision, and miniaturization. Furthermore, with the provision of the polygon mirror 164 as a light path deflecting unit, it is possible to perform optical scanning at a low cost and with high precision. Furthermore, in accordance with this configuration, it is possible to reduce the use amount of the LD, which is expensive and generates a large volume of heat. Therefore, it is possible to attain the reduction of the heat generated in the heat unit 11, the reduction of the number of parts, and the simplification of circuits.

Next, referring to FIGS. 27 through 29, a description is made of a relationship between the head unit and the maintenance unit.

The wiping operation for the head unit 11 is performed in such a manner that the wiper blades 175 (175*a*, 175*b*, and 175*c*) are slid in the direction (the arrangement direction of the head 101 and the longitudinal direction of the head unit) as indicated by the arrow C shown in FIGS. 27 and 28. At this time, the orientation of the light path for detecting liquid droplets is the direction (the width direction of the head unit) as indicated by the arrow D, and the sliding directions of the wiper blades are orthogonal to the light axis.

Under such a movement of the wiper blades 175, waste ink is less likely to adhere to the optical parts (the light-emitting/light-receiving mirror 161 and the reflection mirror 162), thereby making it possible to suppress the reduction of sensitivity due to stains of ink adhesion. With the provision of the grooves 157 between the head peripheral member 160 and the optical parts, it is possible to stop the flowing of ink leaking from the ends of the wiper blades 175 to the optical parts during the sliding of the wiper blade 175 and reduce stains on the optical parts.

Furthermore, the wiper blades 175*a* and 175*c* on both sides out of the three wiper blades 175 are obliquely arranged in such a manner that wiping ends of the wiper blades 175*a* and 175*c* close to the optical parts (the light-emitting/light-receiving mirror 161 and the reflection mirror 162) are located on the downstream side in the sliding direction (the arrow C) while wiping ends thereof on the opposite side are located on the upstream side in the sliding direction. Accordingly, the wiping operation is first performed on the sides of the wiping ends of the wiper blades 175*a* and 175*c* close to the optical parts (the light-emitting/light-receiving mirror 161 and the reflection mirror 162), whereby the scraped ink is put together at the central part of the head unit. As a result, the ink scraped by the wiper blades 175*a* and 175*c* is moved away from the optical parts, thereby making it possible to reduce the stain of ink on the optical parts. Therefore, ink stains can be further prevented, thereby suppressing the reduction of sensitivity.

Next, referring to FIG. 29, a description is made of a relationship between the arrangement positions of the light-emitting/light-receiving mirror 161 and the reflection mirror 162 and the cap-nipping area 158 (which the cap 153 comes into contact with).

As described above, in the head unit 11, the light-emitting/light-receiving mirror 161 and the reflection mirror 162 are arranged in the width direction of the head unit 11. Accordingly, in the width direction of the head unit 11, the length Wc of the cap-nipping position 158 is larger than the head arrangement length Wh of the two heads 101 and 101, the length Ww of the wiping area is larger than the length Wc of the cap-nipping position 158, and the light path length Ws of the detection area 169 between the optical parts is larger than the lengths Wh, Wc, and Ww.

In other words, the relationship Wc>Wh is established so as to cover the nozzle surfaces 104 of the heads 101 with the cap 151, the relationship Ws>Wc is established so as not to pose an impediment in the cap 151 and so as to prevent the optical parts from being stained by ink at the time of capping and discharging ink, and the relationship Ws>Ws is established so as to improve the flatness of the wiping surface and the wiping performance.

Figure 30:
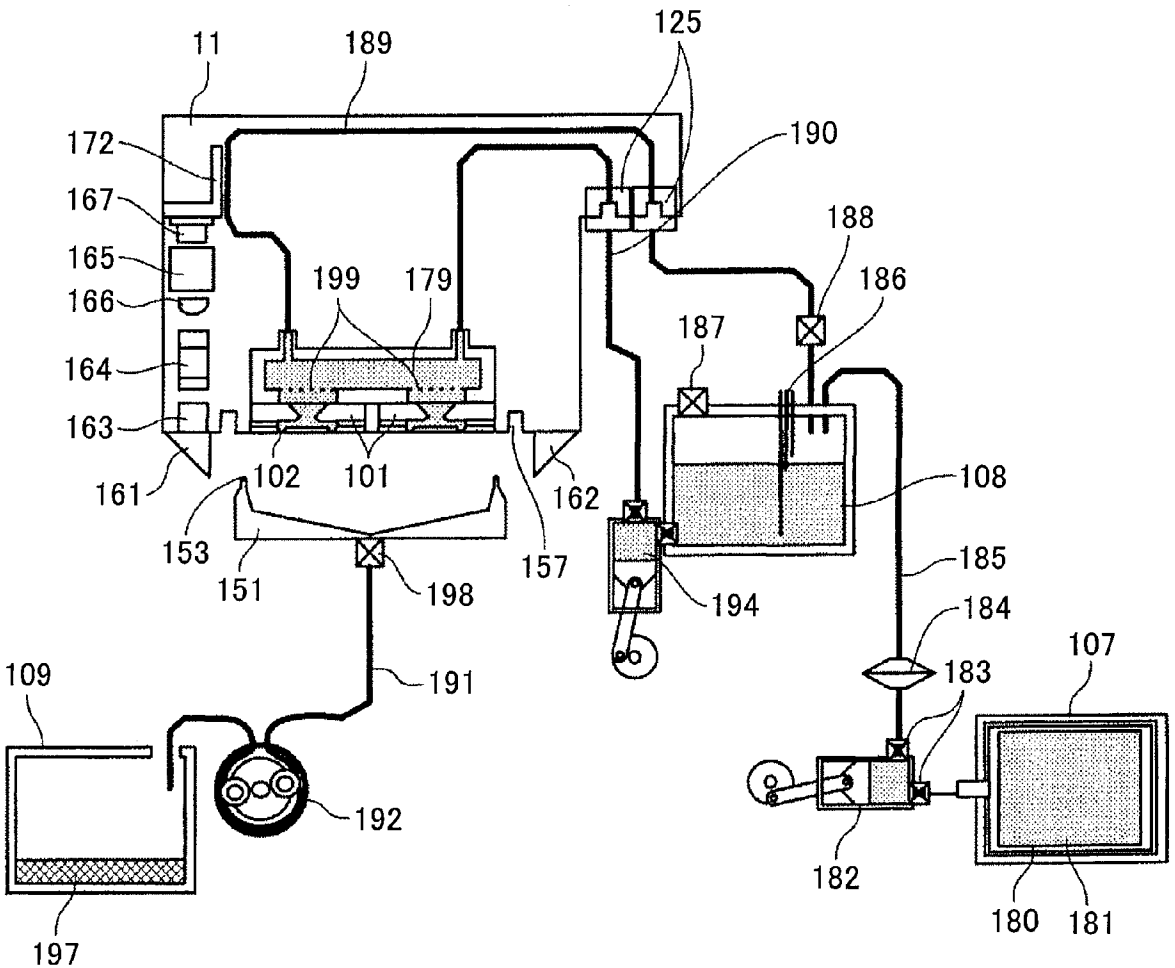
FIG. 30 is a schematic view for explaining an ink supplying system of an apparatus having the head unit.

Next, referring to FIG. 30, a description is made of ink paths of an ink jet apparatus using the head unit 11.

First, as shown in FIG. 30, the ink cartridge 107 is composed of the cartridge case 180 and the ink bag 180 having ink stored therein. When the ink cartridge 107 is attached to the ink jet apparatus, the ink supplying path of the ink bag 181 is communicated with that of the ink jet apparatus. Because the ink is put in an inner bag, it is isolated from air, thereby making it possible to prevent oxidation and degradation and air from dissolving in the ink. However, it is also possible to provide a cartridge with an air communication channel through which the ink is directly put into the cartridge.

The ink is supplied from the ink cartridge 107 to a sub-ink tank 108 by a supply pump 182 and stored in it. When the ink is caused to pass through an ink filter 184 in the path from the ink cartridge 107 to the sub-ink tank 108, coarse particles causing an ejection failure of the ink can be filtered. Therefore, ejection reliability can be improved. As the supply pump 182, general liquid feeding pumps such as diaphragms and tubing pumps are available. However, the supply pump 182 is not particularly limited so long as its members are not eroded to be swelled or dissolved. Furthermore, the ink filter 184 is preferably a mesh of 20 μm or smaller and particularly preferably a mesh of 10 μm or smaller. However, an excessively-small mesh causes large resistance, thereby increasing liquid feeding loads of the supply pump 182.

The ink supplied to the sub-ink tank 108 comes into contact with sensor electrodes 186. Through the measurement of the conductivity between the electrodes 186, it is determined whether the amount of the ink in the sub-ink tank 108 is a specified value. If the amount of the ink exceeds the specified value, this status is informed from the I/O 322 of the controlling unit 300 to the CPU 301. Then, the feeding liquid suction motor driving controlling unit 316 stops the ink supplying motor 318 to stop the supply pump 182. As a result, the supply of the ink is stopped. Accordingly, a certain amount of the ink can be maintained in the sub-ink tank 108.

Note that the sensor electrodes 186 may be any of a first-level type composed of two sensor electrodes, a second-level type composed of three sensor electrodes, and a multiple-level type that can determine multiple levels. Besides the method using the electrodes, the amount of liquid in the sub-ink tank 108 can be detected using a sensor for evaluating the level of liquid in accordance with an optical method using the light transmission characteristics and the refractive index of ink, a method using capacitance, an magnetic detection method in which a float and a magnet are combined together.

Furthermore, when liquid is taken out and put in the sub-ink tank 108, such as cases where the ink is supplied from the ink cartridge 107 to the sub-ink tank 108 or where printing operations are performed, a sub-ink tank atmospheric opening valve 187 provided in the sub-ink tank 108 is opened to maintain the pressure inside the sub-ink tank 108 at atmospheric pressure.

The ink is fed from the sub-ink tank 108 to the heads 101 via a supplying path 190 and connected to common liquid chambers of the heads 101. In the structure of the head unit 11, a negative pressure is applied from the sub-ink tank 108 to the heads 101 either by an automatic manner using a water head or by an active manner using a valve or a pump, so that a pressure of the surface tension or greater is naturally applied to prevent the ink from leaking out the heads 101. Furthermore, because the ink has to be supplied in accordance with the printing and maintenance operations, the supplying path 190 requires a pipe area having an ink-supplying capability enough to deal with even a maximum use amount of the ink.

Furthermore, with the provision of a liquid feeding pump 194 that supplies the ink from the sub-ink tank 108 to the heads 101 and an ink returning path 189 through which the ink is returned from the heads 101 to the sub-ink tank 108, the ink of the head unit 11 can be circulated. Through the circulation of the ink, air bubbles causing an ejection failure can be ejected from the heads 101. Furthermore, with the LD fixing plate 172 coming into contact with the ink returning path 189, it is possible to eject from the head units 11 the waste heat from the LD arrays 170, which is generated to detect the ejection of liquid droplets.

The ink supplied to the heads 101 is moved from the common liquid chambers 179 to separate liquid chambers via filters 199 and then ejected as liquid droplets from the nozzles 102 at the ends of the separate liquid chambers by the pressure of a pressure generating unit.

In order to make the head unit 11 detachable, the head unit 11 is connected to the ink path via ink tube joints 125. In the ink tube joints 125, the ink is sealed by a gasket made of an elastic member having an ink-resistant property. Accordingly, the leakage of the ink from a connection part between the head unit 11 and the ink path is prevented.

When the ink is ejected from the head 101 as the maintenance operation, the cap-nipping part 153 opposing the heads 101 and made of an elastic member is arranged so as to be closely attached to the head surface 100A of the head unit 11 so that the ink falls within the cap 151. The ink fallen within the cap 151 is sucked and ejected to a suction path 191 connected to a suction pump 192 via a cap suction port (ejection port) located on the downstream side of the cap 151.

At the time of a sucking operation, the suction pump 192 rotates to eject the ink to a waste liquid tank 109. The ejected ink is stored in the waste liquid tank 109 as waste ink 197. The waste liquid tank 109 is capable of being replaced in accordance with the amount of the ink stored therein.

The cap 151 may have an atmospheric opening valve for opening the pressure inside the suction path at the time of the sucking operation. In addition, the atmospheric opening valve can also be used for eliminating liquid of the suction path.

Figure 31:
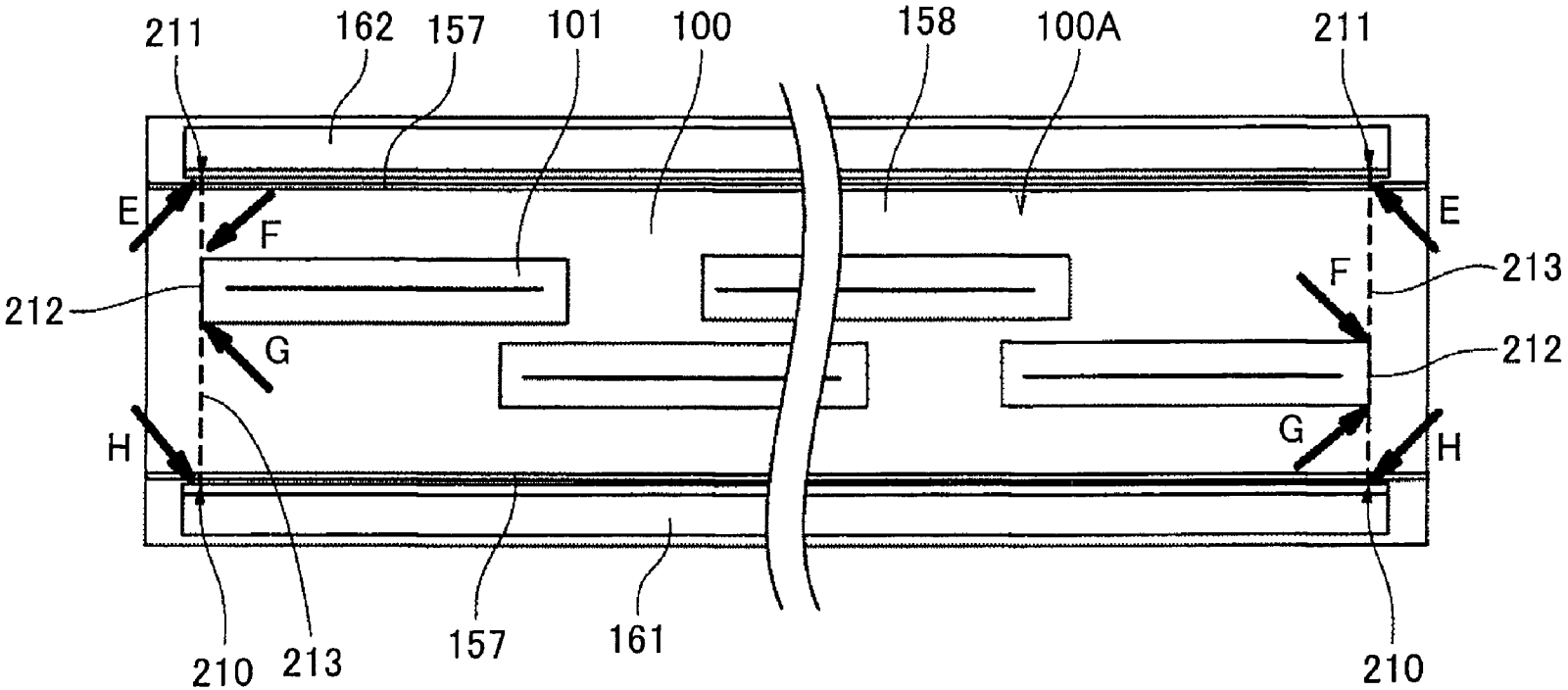
FIG. 31 is a plan view for explaining a method of assembling the head unit.
Figure 32:
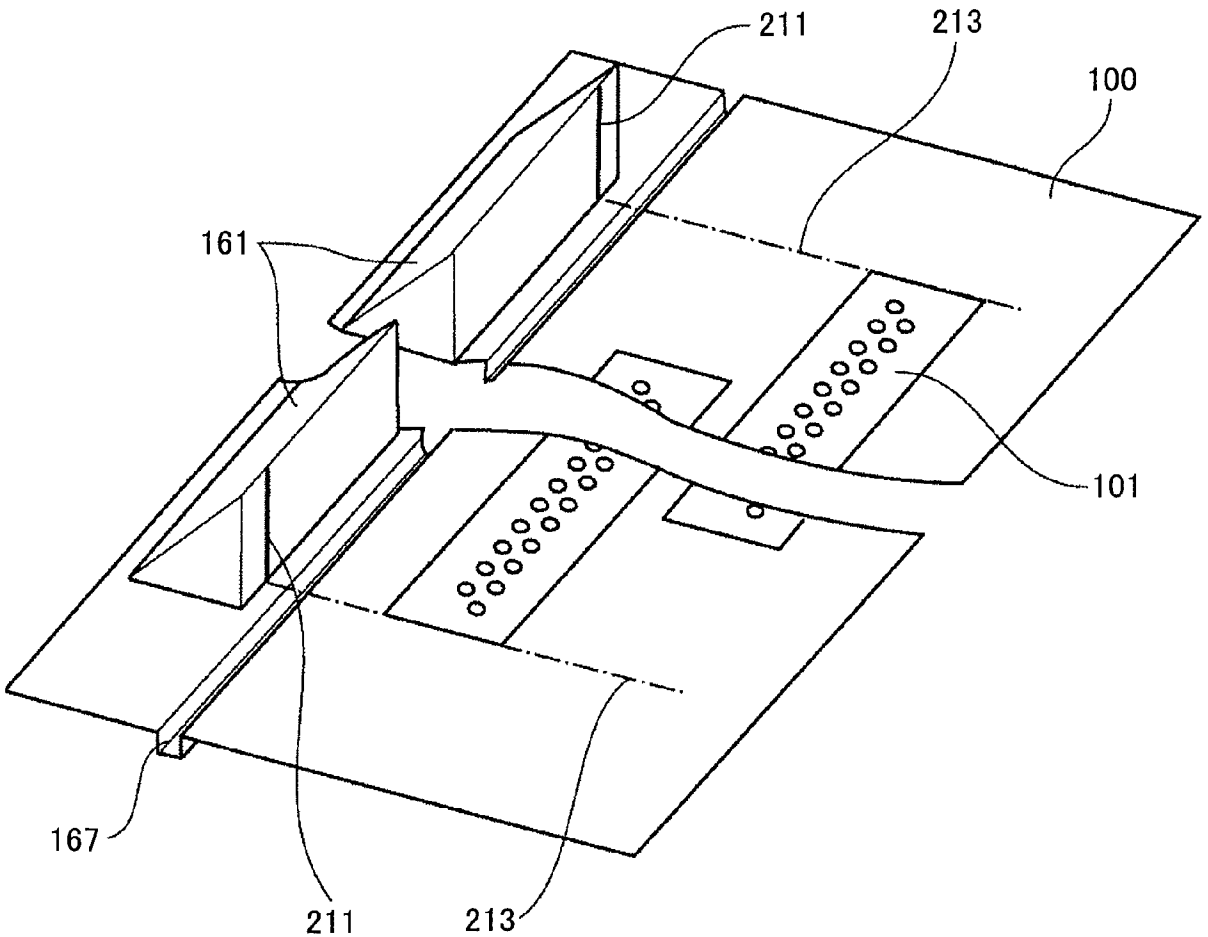
FIG. 32 is a perspective view for explaining the method of assembling the head unit.
Figure 33:
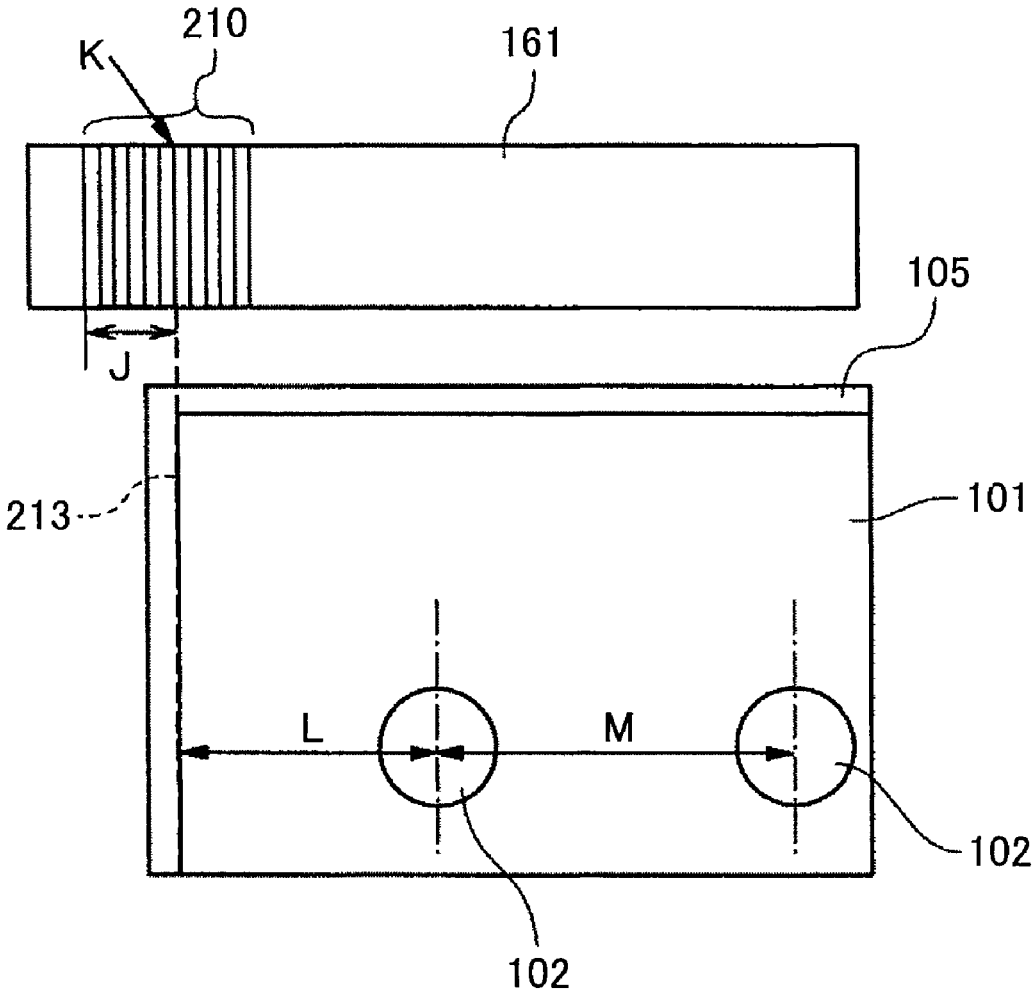
FIG. 33 is a schematic view for explaining a method of adjusting the head unit.

Here, referring to FIGS. 31 through 33, a description is made of a method of assembling the head unit 11. Note that FIG. 31 is a plan view for explaining the method, FIG. 32 is a perspective view of a substantial part of the head unit 11, and FIG. 33 is a schematic view of the head unit 11.

In assembling the head unit 11, it is important to align a liquid droplet detection part with a liquid droplet ejection part. Therefore, it is preferable that the optical parts be aligned while they are assembled into the head unit 11 after the optical parts and the liquid droplet ejection part of the head unit 11 are separately assembled. Only with the assembling of the optical parts, the light-emitting unit, the lenses, and the mirrors can be assembled together, while maintaining their positional relationship with high precision. Accordingly, it is possible to improve cleanness in assembling the optical parts compared with a general assembling process.

When the positions of the optical parts are not aligned with those of the heads 101 in assembling the head unit 11, a proper light axis cannot be obtained. If the reference position is not clearly specified when a scanning operation is performed by the rotation of the polygon mirror, the nozzles 102 and the light axis (the detection light beam 218) cannot match each other.

In order to solve this problem, as shown in FIG. 31, besides the parallel arrangement of the light-emitting/light-receiving mirror 161 and the reflection mirror 162, a light-emitting/light-receiving mirror alignment mark 210 and a reflection mirror alignment mark 211 are put on the light-emitting/light-receiving mirror 161 and the reflection mirror 162, respectively, and they are aligned so that alignment positions a certain distance away from the nozzles 102 of the heads 101 fall within a certain area.

In an example shown in FIG. 31, assume that the alignment positions of the heads 101 are head alignment surfaces 212. When the adjustment of the heads 101 is made, the ends (as indicated by the arrows F and G) of the head alignment surfaces 212 are set to be aligned with the light-emitting/light-receiving mirror alignment marks 210 (as indicated by the arrows H) and the reflection mirror alignment marks 211 (as indicated by the arrows E).

The alignment positions are preferably based on the outermost ends of the heads 101 on the sides of the both ends in the longitudinal direction of the head unit 11. The adjustment can be made in such a manner that the heads 101 are aligned with the alignment marks 210 and 211 of the light-emitting/light-receiving mirror 161 and the reflection mirror 162, respectively, along the alignment lines 213. The alignment lines 213 may be put on the head supporting member 100 as lines for adjusting the assembling of the head unit 11.

Furthermore, it is possible to put the alignment marks 210 and 211 of the light-emitting/light-receiving mirror 161 and the reflection mirror 162 on the mirror surfaces thereof so long as they do not interfere with the detection of the nozzles. With the provision of the reflection mirror alignment marks 211 shown in FIG. 32 on the surfaces of the light paths of the light-emitting/light-receiving mirror 161 and the reflection mirror 162, it is possible to identify the positions of the ends of the heads 101 with a nozzle detection function. If both ends of the heads 101 can be grasped, the positions of the ejection nozzles can be found out.

Such an adjustment may become imprecise during the assembling of the head unit 11. In order to eliminate the necessity of making a slight adjustment after the assembling of the head unit 11, plural of the alignment marks 210 are put on the light-emitting/light-receiving mirror 161 in advance at small regular intervals as shown in FIG. 33, and the mark most matching the alignment line 213 is examined in an inspection step to be registered. Accordingly, it is possible to correct the position after the assembling of the head unit 11.

When the position of the alignment mark 210 of the light-emitting/light-receiving mirror 161 is found out, a shift amount J from the start position of the mark 210 is obtained by multiplying the interval between the marks 210 by the number of the marks 210 up to matching position (the position as indicated by the arrow K). The distance L from the adjustment surface of the head 101 to the endmost nozzle 102 as well as the interval M between the nozzles are specified in advance. Therefore, the detection position of the ejection nozzle can be calculated based on the position of the endmost mark 210 on the surface of the light-emitting/light-receiving mirror 161. Accordingly, it is possible to adjust the head unit 11 without adjusting the parts.

With the provision of the adjustment units, it is possible to easily adjust the light axis when the head unit 11 is assembled. Furthermore, the adjustment of the light axis is not required at the time of assembling the head unit 11 into the ink jet apparatus because it is completed only by the head unit 11. Therefore, uniting workability of the ink jet apparatus is improved. Moreover, because it is possible to replace only the head unit 11 without having a special function of adjusting the light axis, an improvement in maintenance and the simplification of the ink jet apparatus can be realized.

Figure 34:
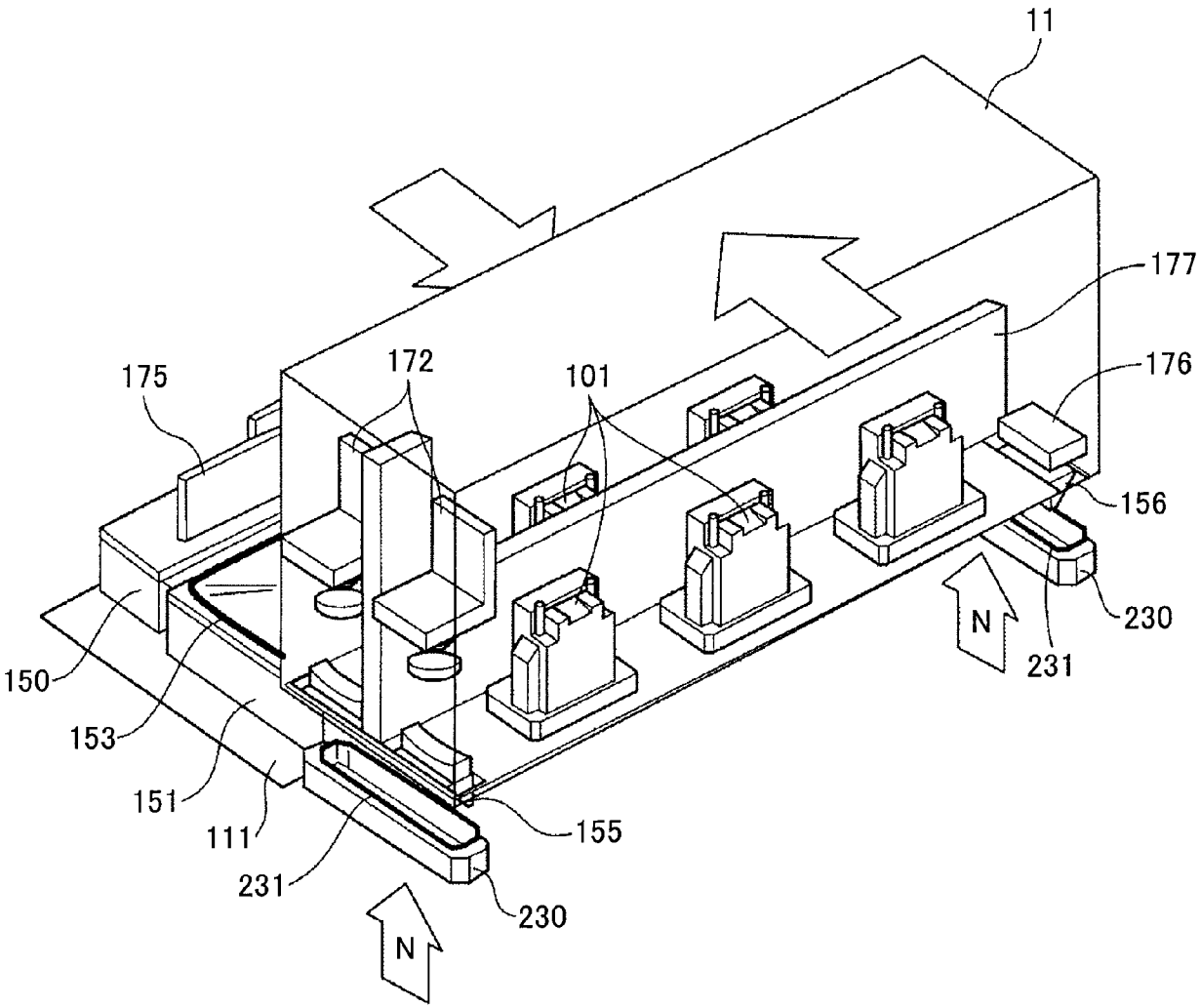
FIG. 34 is a perspective view of a third embodiment of a liquid ejection head unit according to the present invention.

Next, referring to FIG. 34, a description is made of a third embodiment of the liquid ejection head unit according to the present invention. Note that FIG. 34 is a perspective view of the head unit and the maintenance unit.

The head unit 11 has movable protection caps 230 as protection members that cover and protect the light-emitting mirror 155 and the light-receiving mirror 156 as the optical parts according to the first embodiment. Other configurations of the head unit 11 of this embodiment are the same as those of the head unit of the first embodiment.

Thus, the protection caps 230, which protect the optical parts (light-emitting mirror 155 and the light-receiving mirror 156) projecting on the head surface 100A of the head unit 11, are provided with cap-nipping parts 231 made of an elastic member so as to prevent the penetration of ink into the protection caps 230 and alleviate an impact generated when the protection caps 230 come into contact with the light-emitting mirror 155 and the light-receiving mirror 156. The protection caps 230 are closely attached to the head surface 100A in a state where the cap-nipping parts 230 cover the optical parts with its elastic member deformed.

Accordingly, the adhesion of ink of the head surface 100A to the optical parts is prevented, thereby making it possible to prevent the reduction of sensitivity of the liquid droplet detection unit.

Next, referring to FIG. 35, a description is made of the maintenance operation when the head unit 11 is provided. First, a process is moved from the printing operation shown in FIG. 35A to the maintenance operation in which the projecting parts of the light-emitting mirror 155 and the light-receiving mirror 156 are covered with the optical protection cap 230 as shown in FIG. 35B.

Figure 35A:
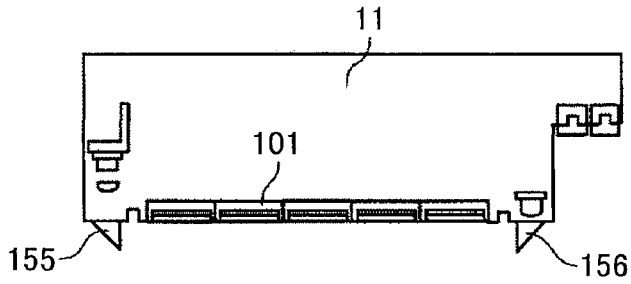
FIGS. 35A through 35E are illustrations for explaining of the maintenance operation.
Figure 35B:
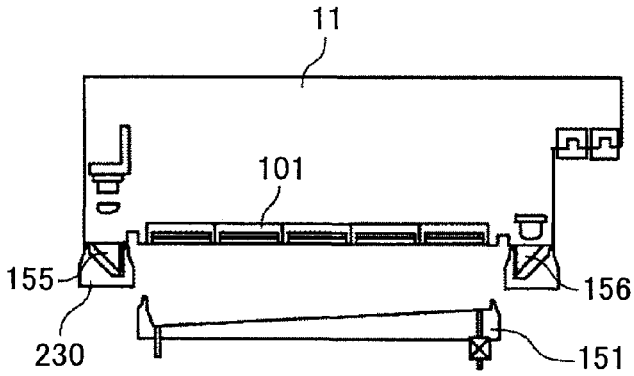
Figure 35C:
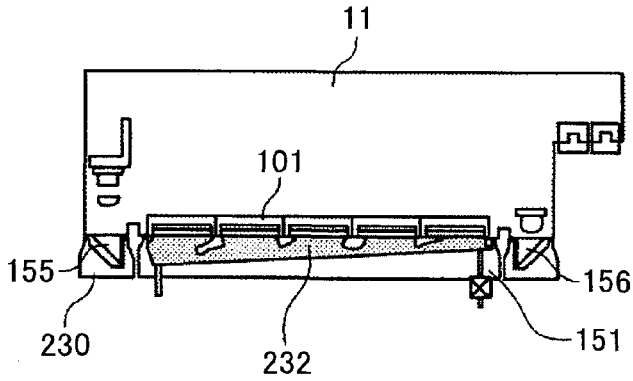
Figure 35D:
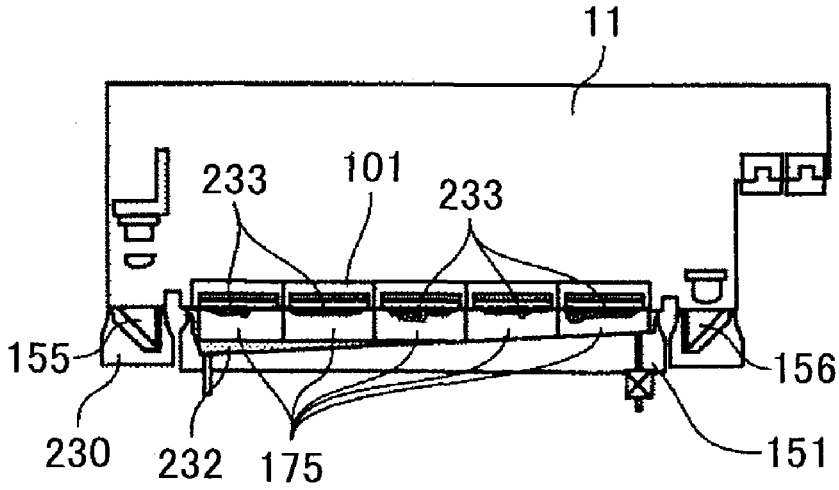
Figure 35E:
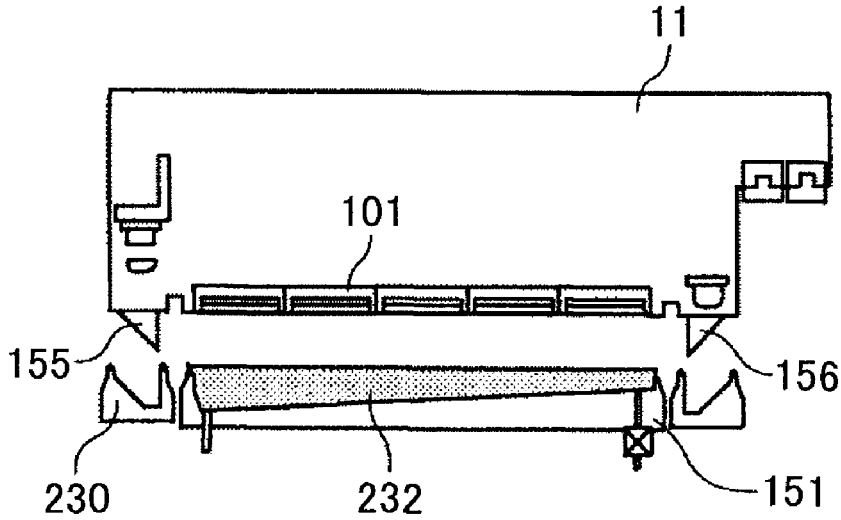

As shown in FIG. 35C, after the cap 151 is closely attached to the head surface 100A, ink is ejected from the heads 101. At this time, the ink 232 ejected from the heads 101 is poured into the cap 151. As shown in FIG. 35D, the cap 151 is then separated from the head surface 100A, the head unit 11 and the maintenance unit 12 are moved relative to each other, and adhesion ink 233 left on the nozzle surfaces 104 of the heads 101 is wiped off by the wiper blades 175. After that, as shown in FIG. 35E, the optical protection cap 230 is separated from the head unit 11 together with the maintenance unit 11.

With the use of the optical protection cap 230, ink stains on the optical parts during the maintenance operation can be completely prevented. Therefore, it is possible to maintain a high S/N ratio at the time of detection and reduce a detection error in detecting liquid droplets. Furthermore, if there is no need to detect liquid droplets, the adhesion of ink mist during the printing operation can be prevented with the protection of the optical parts by the optical protection cap 230.

Figure 36:
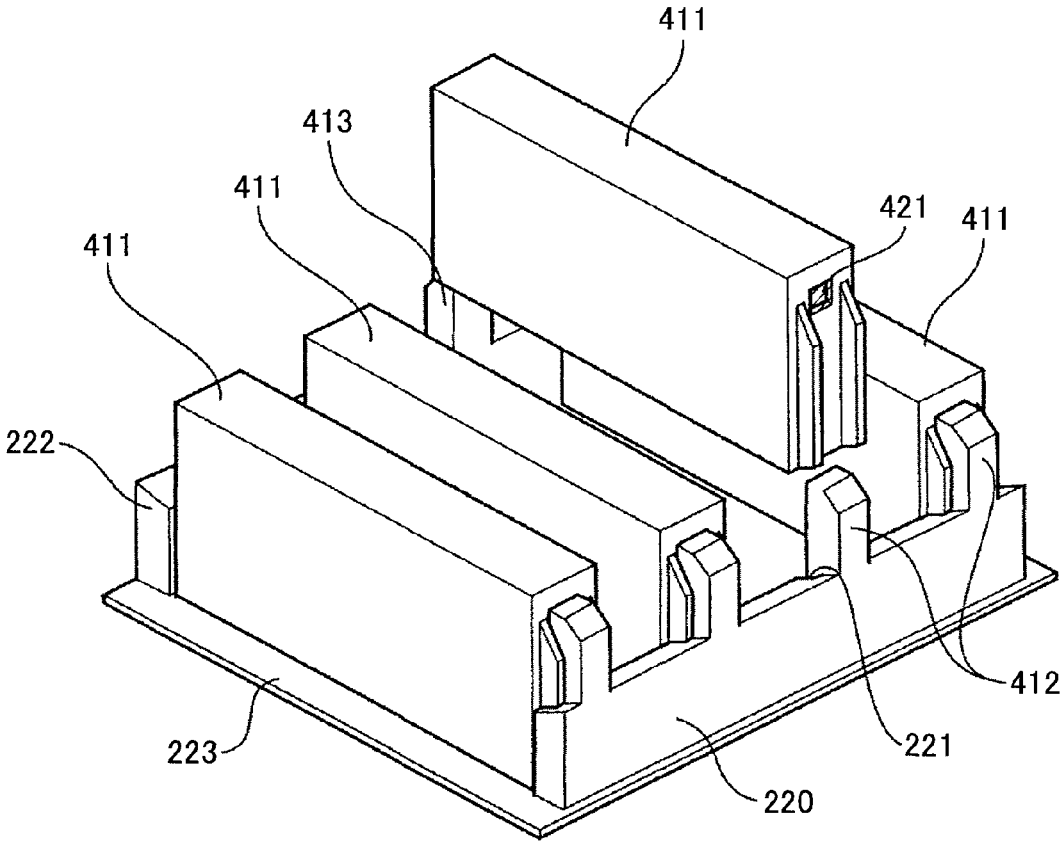
FIG. 36 is a perspective view of a fourth embodiment of a liquid ejection head unit according to the present invention.
Figure 37:
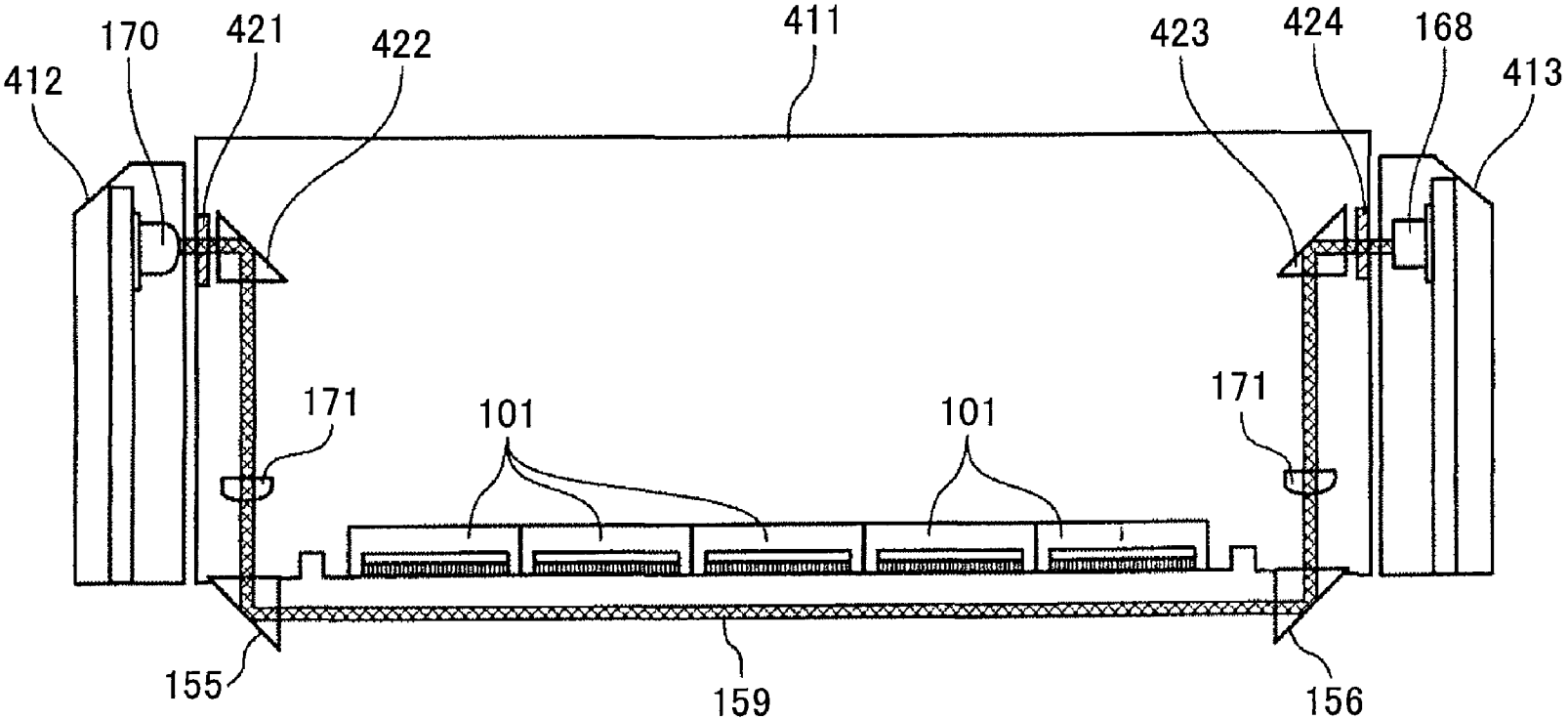
FIG. 37 is an illustration for explaining the liquid droplet detection device and its light paths in the liquid ejection head unit.

Next, referring to FIGS. 36 and 37, a description is made of a fourth embodiment of the liquid ejection head unit according to the present invention. Note that FIG. 36 is a perspective view of the liquid ejection head unit of this embodiment, and FIG. 37 is an illustration for explaining the liquid droplet detection device and its light paths in the liquid ejection head unit.

According to this embodiment, the light path forming unit constituting the liquid droplet detection device 324 of the head unit 11 of the first embodiment is provided on the side of head units 411 (different from the head unit 11 in that they do not include the light-emitting unit and the light-receiving unit) in which the plural heads 101 are unitized, and the LD arrays 170 and the photo diodes 168 constituting the liquid droplet detection device 324 are provided on the side of the head unit supporting member 223 that supports the head units 411. In other words, at least a part of members constituting the light-emitting unit, the light-receiving unit, and the light path forming unit of the liquid droplet detection unit is provided on the side of the liquid ejection heads (the liquid ejection heads themselves or a member that holds the liquid ejection heads), and the rest of them are provided on the side of the member that supports the liquid ejection heads.

Specifically, light-emitting parts 412 including the LD arrays 170 as the light-emitting units are provided in one head unit guide member 222 forming the positioning guide 221 in which the positioning ribs 220 provided on the both ends in the longitudinal direction of the head unit 411 are fitted, and light-receiving parts 413 including the photo diodes 168 as the light-emitting units are provided in the other head unit guide member 222.

The head units 411 have a window 421 on which light beams (laser light beams) emitted from the LD arrays 170 of the light-emitting part are capable of being incident, and is provided with a mirror 422 that causes the light beams made incident through the window 421 to be incident on the light-emitting mirror 155, a mirror 423 that causes the laser light beams (detection light beams) incident on the light-receiving mirror 156 from the light-emitting mirror 155 via the front of the heads 101 to be incident on the photo diodes 168 of the light-receiving part.

Thus, at least a part of the members constituting the light-emitting unit, the light-receiving unit, and the light path forming unit of the liquid droplet detection unit is provided on the side of the liquid ejection heads, and the rest of them are provided on the side of the member that supports the liquid ejection heads. Therefore, the configuration of the liquid ejection head can be made simple.

According to this embodiment, the light-emitting unit and the light-receiving unit are provided on the side where the head units 411 are supported. However, the parts of the light path forming unit, e.g., the light-emitting mirror 422, the beam expander 171, the light-receiving mirror 423, and the beam expander 171 can be provided on the side of the member where the head units 411 are supported. In other words, the constituent members of the liquid droplet detection unit provided in the liquid ejection head are not limited to the above embodiment.

As described above, with the provision of the liquid ejection head units according to the embodiments of the present invention, the flying states of liquid droplets during the printing operation can be detected even in an ink jet recording apparatus (image forming apparatus) having a line-type head. Furthermore, with the provision of the detection unit in the head unit, the head unit can be easily replaced. Moreover, the reliability of the detection unit can be improved.

Note that, in the above embodiments, the present invention is applied to the image forming apparatus having a printer configuration, but it can also be applied to image forming apparatuses such as printers, facsimile machines or copy composite machines. Furthermore, it can also be applied to image forming apparatuses using liquid, a fixing liquid, etc., other than narrowly-defined ink.

The present invention is not limited to the specifically disclosed embodiments, but variations and modifications may be made without departing from the scope of the present invention.

The present application is based on Japanese Priority Application No. 2007-229556 filed on Sep. 4, 2007, the entire contents of which are hereby incorporated herein by reference.

What is claimed is:

1. An image forming apparatus comprising:

a liquid ejection head unit including a liquid ejection head that has a nozzle surface provided with plural nozzles through which a liquid droplet is ejected, and a liquid droplet detection unit that detects the liquid droplet ejected from the liquid ejection head; and a maintenance and recovery mechanism including a capping unit, wherein the liquid droplet detection unit has a light-emitting unit that emits a light beam, a light-receiving unit that receives the light beam emitted from the light-emitting unit, and a light path forming unit that causes the light beam emitted from the light-emitting unit to pass through along the nozzle surface from outside of an area, of the nozzle surface, capped by the capping unit and that causes the light beam to be incident on the light-receiving unit provided outside of the area, and wherein the light beam from the light-emitting unit scans a light path on the plural nozzles along a longitudinal direction of the liquid ejection head unit, the light-emitting unit and the light-receiving unit are arranged at respective different ends in the longitudinal direction of the liquid ejection head unit, and grooves are provided at said respective different ends in the longitudinal direction of the liquid ejection head unit, and each of the grooves is arranged in an area that is outside the capped area of the liquid ejection head unit and outside the nozzle surface of the liquid ejection head, that is between (i) an outer side of the capped area and (ii) any one of the light-emitting unit and the light-receiving unit, and that is between plural parts of the light path forming unit.

2. The image forming apparatus according to claim 1, wherein the light-emitting unit comes into contact with a channel of ink ejected as the liquid droplet via a thermally-conductive member.

3. The image forming apparatus according to claim 1, wherein the liquid droplet detection unit further comprises:

a movable protection member that covers and protects any of the light-emitting unit, the light-receiving unit, and the light path forming unit.

4. The image forming apparatus according to claim 1, wherein detection by the liquid droplet detection unit is performed when a liquid droplet that does not contribute to image formation is ejected.

5. The image forming apparatus according to claim 1, wherein a passing direction of the light beam emitted from the liquid droplet detection unit intersects with a wiping direction of a wiping member that wipes off the nozzle surface of the liquid ejection head.

6. The image forming apparatus according to claim 1, wherein said each of the grooves is configured to prevent liquid ejected by the liquid ejection head from reaching said any of the light-emitting unit and the light-receiving unit.

7. The image forming apparatus according to claim 1, wherein said maintenance and recovery mechanism further includes a wiping unit configured to wipe the nozzle surface, and said each of the grooves is configured to prevent liquid wiped by the wiping unit from reaching said any of the light-emitting unit and the light-receiving unit.

8. A liquid ejection head unit comprising:

a liquid ejection head that has a nozzle surface provided with plural nozzles through which a liquid droplet is ejected; and a liquid droplet detection unit that detects the liquid droplet ejected from the liquid ejection head; wherein the liquid droplet detection unit has a light-emitting unit that emits a light beam, a light-receiving unit that receives the light beam emitted from the light-emitting unit, and a light path forming unit that causes the light beam emitted from the light-emitting unit to pass through along the nozzle surface from an outer side of an area capped by a capping unit of a maintenance and recovery mechanism of an image forming apparatus and that causes the light beam to be incident on the light-receiving unit provided at the outer side of the area, and wherein the liquid droplet detection unit has a digital micro mirror device that selects the light beam to be incident on the light-receiving unit.

9. An image forming apparatus comprising the liquid ejection head according to claim 8 for forming an image on a printing medium.

10. The image forming apparatus according to claim 9, wherein detection by the liquid droplet detection unit is performed when a liquid droplet that does not contribute to image formation is ejected.

11. The image forming apparatus according to claim 9, wherein a passing direction of the light beam emitted from the liquid droplet detection unit intersects with a wiping direction of a wiping member that wipes off the nozzle surface of the liquid ejection head.

12. The image forming apparatus according to claim 9, wherein the light-emitting unit comes into contact with a channel of ink ejected as the liquid droplet via a thermally-conductive member.

13. The image forming apparatus according to claim 9, wherein the liquid droplet detection unit further comprises:

a movable protection member that covers and protects any of the light-emitting unit, the light-receiving unit, and the light path forming unit.

* * * * *